US008369531B2

(12) United States Patent
Yokota

(10) Patent No.: US 8,369,531 B2
(45) Date of Patent: Feb. 5, 2013

(54) AUDIO REPRODUCING APPARATUS AND METHOD THEREOF

(75) Inventor: Teppei Yokota, Chiba (JP)

(73) Assignee: Sony Corporation, Tokyo (JP)

( * ) Notice: Subject to any disclaimer, the term of this patent is extended or adjusted under 35 U.S.C. 154(b) by 1543 days.

(21) Appl. No.: 11/655,013

(22) Filed: Jan. 18, 2007

(65) Prior Publication Data

US 2007/0195964 A1 Aug. 23, 2007

(30) Foreign Application Priority Data

Jan. 23, 2006 (JP) ..... 2006-013464

(51) Int. Cl.
*H04R 5/00* (2006.01)
*H04R 5/02* (2006.01)
*H04R 3/00* (2006.01)

(52) U.S. Cl. ..... 381/1; 381/17; 381/18; 381/300; 381/307; 381/111

(58) Field of Classification Search ..... 381/1, 17–19, 381/300–309, 26, 111, 122, 56
See application file for complete search history.

(56) References Cited

U.S. PATENT DOCUMENTS

| | | | | |
|---|---|---|---|---|
| 3,115,947 | A | 12/1963 | Wood | |
| 3,824,343 | A | 7/1974 | Dahlquist | |
| 3,870,834 | A | 3/1975 | Yeaple | |
| 5,282,251 | A * | 1/1994 | Petersen | 381/333 |
| 5,887,071 | A | 3/1999 | House | |
| 7,336,792 | B2 | 2/2008 | Sasaki | |
| 2003/0099369 | A1 | 5/2003 | Cheng | |
| 2003/0103636 | A1 | 6/2003 | Arai et al. | |
| 2007/0183617 | A1 | 8/2007 | Yokota et al. | |
| 2008/0187156 | A1 | 8/2008 | Yokota | |
| 2008/0292121 | A1 | 11/2008 | Yokota | |

FOREIGN PATENT DOCUMENTS

| | | | |
|---|---|---|---|
| CN | 1419796 | A | 5/2003 |
| EP | 1137319 | A3 | 7/2003 |
| EP | 1439509 | | 7/2004 |
| FR | 2859863 | | 3/2005 |
| GB | 2426169 | A | 5/2005 |
| JP | 61-95189 | | 6/1986 |
| JP | 03-069466 | U | 7/1991 |
| JP | 03-235498 | A | 10/1991 |
| JP | 5-95591 | | 4/1993 |
| JP | 05-191342 | A | 7/1993 |
| JP | 08-047080 | A | 2/1996 |
| JP | 9-284883 | | 10/1997 |
| JP | 09-298797 | A | 11/1997 |
| JP | 09-327099 | A | 12/1997 |
| JP | 10-014000 | A | 1/1998 |
| JP | 10-224900 | A | 8/1998 |

(Continued)

*Primary Examiner* — Devona Faulk
(74) *Attorney, Agent, or Firm* — Wolf, Greenfield & Sacks, P.C.

(57) ABSTRACT

An audio reproducing apparatus includes the following elements: an output circuit operable to generate audio signals to be supplied to first and second speakers placed near the ears of a listener; and a detector operable to detect the presence of sound output from other speakers placed at positions further away from the listener than the first and second speakers. When it is determined that there is no sound output from the other speakers on the basis of a detection result obtained by the detector, the output circuit performs a control operation so that audio signals to be supplied to the other speakers are supplied to the first and second speakers.

21 Claims, 17 Drawing Sheets

FOREIGN PATENT DOCUMENTS

| | | | | |
|---|---|---|---|---|
| JP | 10-243500 | A | | 9/1998 |
| JP | 2001-078288 | A | | 3/2001 |
| JP | 2001-268700 | A | | 9/2001 |
| JP | 2002-269916 | A | | 9/2002 |
| JP | 2002-291100 | A | | 10/2002 |
| JP | 2003-061197 | | | 2/2003 |
| JP | 2004-135023 | A | | 4/2004 |
| JP | 2004-187300 | A | | 7/2004 |
| JP | 2004-289762 | A | | 10/2004 |
| JP | 2004-357075 | A | | 12/2004 |
| JP | 2005-45533 | | | 2/2005 |
| JP | 2005045533 | A | * | 2/2005 |
| JP | 2005-280580 | A | | 10/2005 |
| JP | 2006-245477 | A | | 9/2006 |
| JP | 2006-345477 | A | | 12/2006 |
| JP | 2006-345480 | A | | 12/2006 |
| JP | 2007-001507 | A | | 1/2007 |
| JP | 2007-195092 | A | | 8/2007 |
| WO | WO 2006/109389 | A1 | | 10/2006 |

* cited by examiner

RELATIONSHIP BETWEEN DISTANCE AND SOUND PRESSURE (17-cm CONE)

AUDIO REPRODUCING APPARATUS AND METHOD THEREOF

CROSS REFERENCES TO RELATED APPLICATIONS

The present invention contains subject matter related to Japanese Patent Application JP 2006-013464 filed in the Japanese Patent Office on Jan. 23, 2006, the entire contents of which are incorporated herein by reference.

BACKGROUND OF THE INVENTION

1. Field of the Invention

The present invention relates to audio reproducing apparatuses and methods thereof for reducing noise to the outside while providing sound with sufficient volume.

2. Description of the Related Art

Audio-video reproducing systems referred to as "home theater systems" are becoming popular. In the audio-video reproducing systems, for example, video reproduction from a digital versatile disc (DVD) is performed by displaying a reproduced video image on a relatively large display, and sound reproduction employs a multi-channel system, recently a 5.1-channel system, thereby providing dynamic audio and video reproduction.

In the 5.1-channel sound reproducing system, six speakers of four types, namely, front, center, rear, and subwoofer, are placed at appropriate positions, and the speakers are played with relatively large volume.

That is, a front-left channel speaker is placed at the left, a front-right channel speaker is placed at the right, and a center channel speaker is placed at the center in front of a listener. A rear-left channel speaker is placed at the left and a rear-right channel speaker is placed at the right behind the listener. A subwoofer speaker for the low frequency effects (LFE) channel is placed at an appropriate position. The LFE channel carries low frequencies of about 100 to 120 Hz to provide deep bass and dynamic impact.

These six speakers are mounted on associated speaker boxes (enclosures) and placed at appropriate positions. In general, the six front and rear speakers are often placed within a distance of, for example, about 2 meters from the listener.

In such a known audio reproducing system, left (L) and right (R) speakers that have been used to be mounted on speaker boxes of about 15 liters, for example, are now mounted on small boxes of about 1 liter and are also referred to as "satellite speakers". These speakers lack low-frequency sounds. To compensate for the lack of low-frequency sounds, a low-frequency-dedicated speaker referred to as a "subwoofer" is added. When speakers other than the subwoofer are housed in small boxes, the crossover frequency of an audio signal supplied to the subwoofer is 150 Hz, which is a quite low frequency, though this is somewhat higher than the aforementioned 100 Hz.

When a 5.1-channel audio signal is reproduced from a DVD in such a speaker system with the above-described placement, sufficient low sounds are naturally played. Since a dedicated LFE-channel is provided for reproduction, the speaker system provides "room-filling" bass from a source such as a movie, which was not achieved by known speaker systems, thereby providing dynamic impact.

In the above-described multi-channel audio reproducing system, it is necessary to turn the volume of the aforementioned six speakers relatively loud in order to enable the listener to appreciate surround localization and dynamic impact of deep bass.

In a house with less strongly built walls and floors, such sound reproduction at high volume produces unpleasant noise. In particular, low bass around 50 Hz or 40 Hz provided by the subwoofer is powerful and is conveyed through quite a wide range. It is thus difficult for the listener to appreciate a source such as a movie from a DVD with sufficient performance. This problem is particularly serious at midnight. A volume that is not noticeable during the day time because of external noises becomes annoying at night. The situation is that the function of the multi-channel audio reproducing system is hardly ever used to achieve sufficient sound volume during hours in which the user has time to see DVDs.

An exemplary solution to the problem is described in Japanese Unexamined Patent Application Publication No. 5-95591. This proposes an audio reproducing system in which middle and high frequency sounds are reproduced by small speakers (speaker units are housed in speaker boxes) and low frequencies are reproduced by a low-frequency headphone or using bone conduction so that sound is reproduced near the ears of a listener.

According to the technology described in the aforementioned patent document, low bass is reproduced near the ears of the listener using a headphone or bone conduction. Thus, the sound is heard by the listener at high volume, although the sound is not conveyed to the listener's neighbors.

SUMMARY OF THE INVENTION

According to the invention described in Japanese Unexamined Patent Application Publication No. 5-95591, even when low-frequency sound is reproduced near the ears, it is reproduced not by a speaker, but by a headphone or a vibrator using bone conduction. Though it may be different among individuals, the same low bass impact as that provided by speakers is difficult to feel using a vibrator other than speakers, which may be hardly accepted by general public. Also, the listener may feel it bothersome to wear a headphone or a bone-conduction headset.

It is desirable to provide an audio reproducing apparatus and method thereof for reducing noise to the outside while maintaining the situation in which a listener can hear sound at high volume provided by speakers.

According to an embodiment of the present invention, there is provided an audio reproducing apparatus including the following elements: an output circuit operable to generate audio signals to be supplied to first and second speakers placed near the ears of a listener; and detecting means for detecting the presence of sound output from other speakers placed at positions further away from the listener than the first and second speakers. When it is determined that there is no sound output from the other speakers on the basis of a detection result obtained by the detecting means, the output circuit performs a control operation so that audio signals to be supplied to the other speakers are supplied to the first and second speakers.

For example, in the case where the other speakers are speakers of a television receiver, when the speakers of the television receiver reproduce sound at high volume and when, for example, the listener performs a mute operation to stop sound output from the speakers, the audio detector detects that there is no more sound output from the speakers of the television receiver.

Then, the output circuit supplies the audio signals that had been supplied to the speakers of the television receiver to the first and second speakers placed near the ears of the listener. Thus, the listener can hear sound output from the first and second speakers placed near the ears even when there is no more sound output from the speakers of the television receiver.

Since the speakers of the television receiver are spaced, for example, at least two meters from the listener, the speakers output sound at relatively high volume. However, since the first and second speakers are placed near the ears of the listener, the same volume of sound heard by the listener can be achieved by turning down the volume of the first and second speakers. Thus, noise conveyed to the outside is reduced.

According to the embodiment of the present invention, noise to the outside can be reduced while maintaining the state in which the listener can hear sound at high volume.

DESCRIPTION OF THE PREFERRED EMBODIMENTS

An audio reproducing apparatus according to embodiments of the present invention will be described with reference to the drawings.

First Embodiment

A first embodiment is an example in which a user monitors a video image and listens to 5.1-channel surround sound using a video signal and an audio signal reproduced by a DVD player.

Figure 1:
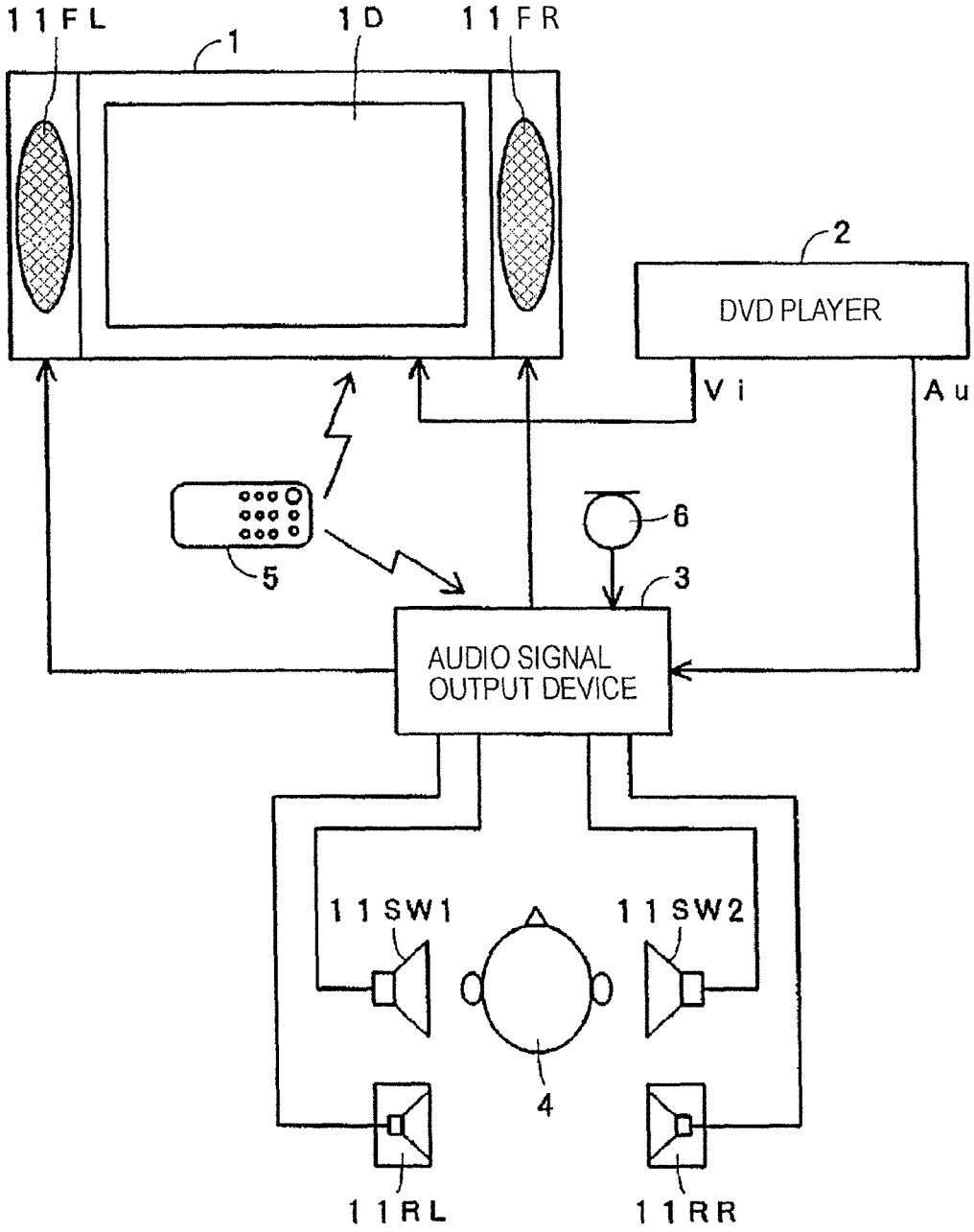
FIG. 1 is a diagram for illustrating the outline of an exemplary audio reproducing system using an audio reproducing apparatus according to a first embodiment of the present invention.

FIG. 1 is a diagram showing the outline of an audio reproducing system including an audio reproducing apparatus according to the first embodiment.

As shown in FIG. 1, the audio reproducing system according to the first embodiment includes a television receiver 1 having two speakers 11FL and 11FR, a DVD player 2, an audio signal output device 3, first and second speakers 11SW1 and 11SW2 placed near the ears of a user 4, a rear-left channel speaker 11RL, and a rear-right channel speaker 11RR.

In the first embodiment, the two speakers 11FL and 11FR for the left and right channels are included inside the television receiver 1. Alternatively, these speakers 11FL and 11FR may be provided as separate devices independent of the television receiver 1, instead of being included in the television receiver 1. These speakers 11FL and 11FR correspond to other speakers.

The television receiver 1 and the audio signal output device 3 can be remotely controlled by a remote commander 5. When the user 4 uses the remote commander 5 to perform a mute operation to mute sound output from the speakers 11FL and 11FR, the remote commander 5 generates a mute signal indicating that the sound output from the speakers 11FL and 11FR is to be muted and supplies the mute signal to the audio signal output device 3. A remote control signal receiver of the audio signal output device 3 receives the mute signal and performs so-called muting control so that no audio signals are supplied to the speakers 11FL and 11FR of the television receiver 1. Thus, no sound is output from the speakers 11FL and 11FR of the television receiver 1.

Alternatively, instead of the audio signal output device 3 performing muting control in accordance with the mute signal, the television receiver 1 may perform muting control in accordance with the received mute signal.

A remote commander of the DVD player 2 is omitted in the example shown in FIG. 1.

The DVD player 2 reproduces and outputs a video signal and an audio signal recorded on a DVD. In this example, a video signal Vi reproduced by the DVD player 2 is supplied to the television receiver 1, and a video image reproduced from the video signal Vi is displayed on a display screen 1D.

In this example, an audio signal Au reproduced by the DVD player 2 is supplied to the audio signal output device 3. In the first embodiment, the audio signal output device 3 has a decoding function corresponding to a 5.1-channel surround system. The audio signal output device 3 generates audio signals to be supplied to the two speakers 11FL and 11FR for the left and right channels, audio signals to be supplied to the rear-left channel speaker 11RL and the rear-right channel speaker 11RR, and audio signals to be supplied to the first and second speakers 11SW1 and 11SW2 placed near the ears of the user 4, and supplies these audio signals to the associated speakers.

The audio signal output device 3 according to the first embodiment has two types of audio detectors for detecting the presence of sound output from the two speakers 11FL and 11FR serving as other speakers. Using one or both of the audio detectors, the audio signal output device 3 detects the presence of sound output from the aforementioned speakers 11FL and 11FR.

One of the audio detectors involves collecting sound output from the two speakers 11FL and 11FR using a microphone 6 and, on the basis of the collected sound signal, determining whether sound is output from the two speakers 11FL and 11FR. In this case, when the determination whether sound is output from the two speakers 11FL and 11FR is made on the basis of determining whether the collected sound signal from the microphone 6 is greater than or equal to a predetermined level, even the case in which there is noise from a sound source other than the two speakers 11FL and 11FR is also determined as that sound is output from the two speakers 11FL and 11FR.

Therefore, the audio detector of the audio signal output device 3 according to the first embodiment determines whether there is correlation between the audio signals supplied to the two speakers 11FL and 11FR, which are generated from the audio signal Au from the DVD player 2, and the collected sound signal from the microphone 6, and, when it is determined that there is correlation, it is then determined that sound is output from the two speakers 11FL and 11FR.

When the audio detector determines that there is no correlation between the audio signals supplied to the two speakers 11FL and 11FR, which are generated from the audio signal Au from the DVD player 2, and the collected sound signal from the microphone 6, it is determined that no sound is output from the two speakers 11FL and 11FR.

The other one of the audio detectors for detecting the presence of sound output from the two speakers 11FL and 11FR involves receiving and analyzing a remote control signal from the remote commander 5 by the audio signal output device 3 and, on the basis of the analysis result, detecting the presence of sound output.

That is, as has been described above, when the user 4 uses the remote commander 5 to perform the aforementioned mute operation, the television receiver 1 stops sound output from the two speakers 11FL and 11FR. When the audio detector of the audio signal output device 3 receives a mute signal, which is a remote control signal in accordance with the mute operation from the remote commander 5, it is determined that there is no sound output from the two speakers 11FL and 11FR.

In this case, when the audio detector confirms reception of the mute signal serving as the remote control signal, it may be determined that there is no sound output from the two speakers 11FL and 11FR. Alternatively, it may be determined that no sound is output from the two speakers 11FL and 11FR after additional confirmation of the correlation determination result output from a correlation determination unit 38.

When sound output from the speakers 11FL and 11FR of the television receiver 1 is turned down to zero through a remote control operation by the user 4 using the remote commander 5, it is determined that there is no sound output from the two speakers 11FL and 11FR on the basis of the correlation determination result output from the correlation determination unit 38.

Alternatively, the television receiver 1 may transmit information indicating the gain or a mute state of an audio output system such as an internal amplifier. When the gain is less than or equal to a predetermined value or when the state is a mute state, it may be determined that there is no sound output.

As will be described later, the audio signal output device 3 reconstructs a 5.1-channel audio signal from the audio signal Au from the DVD player 2 and, from the reconstructed 5.1-channel audio signal, generates the audio signals to be supplied to the two speakers 11FL and 11FR of the television receiver 1, the audio signals to be supplied to the rear-left and rear-right channel speakers 11RL and 11RR, and the audio signals to be supplied to the two speakers 11SW1 and 11SW2 placed near the ears of the user 4, and supplies these audio signals to the associated speakers.

In the first embodiment, the audio signal output device 3 changes the audio signals to be supplied to the two speakers 11SW1 and 11SW2 placed near the ears of the user 4 in accordance with the detection result obtained by the audio detector for detecting the presence of sound output from the two speakers 11FL and 11FR.

The audio detector for detecting the presence of sound output from the two speakers 11FL and 11FR determines, for example, prior to the start of playback by the DVD player 2, that there is sound output from the speakers 11FL and 11FR when the audio signal output device 3 receives no mute signal and when the volume of the speakers 11FL and 11FR of the television receiver 1 is not zero.

When the DVD player 2 starts playing a DVD, since it has been determined that there is sound output from the two speakers 11FL and 11FR, the audio signal output device 3 supplies audio signals generated by adding a center channel audio signal to the front-left and front-right channel audio signals to the two speakers 11FL and 11FR of the television receiver 1, respectively.

At the same time, the audio signal output device 3 supplies the rear-left and rear-right channel audio signals to the rear-left and rear-right channel speakers 11RL and 11RR, respectively. Furthermore, in the first embodiment, when it is determined that there is sound output from the two speakers 11FL and 11FR, the audio signal output device 3 supplies only a low-frequency audio signal of the 5.1-channel audio signal to the two speakers 11SW1 and 11SW2.

In this state, the speakers 11FL and 11FR of the television receiver 1 serve as speakers for the front-left and front-right channels, the speakers 11RL and 11RR serve as speakers for the rear-left and rear-right channels, and the speakers 11SW1 and 11SW2 serve as speakers for low-frequencies (subwoofers). Accordingly, 5.1-channel surround sound is reproduced.

When the user 4 uses the remote commander 5 to perform in this state a mute operation for stopping sound output from the speakers 11FL and 11FR of the television receiver 1, as has been described above in the first embodiment, the audio signal output device 3 receives a mute signal serving as a remote control signal and mutes the audio signals to be supplied to the speakers 11FL and 11FR, thereby stopping sound output.

The audio detector of the audio signal output device 3 determines that there is no sound output from the two speakers 11FL and 11FR. In the first embodiment, besides the low-frequency signal of the 5.1-channel audio signal, the audio signals that had been supplied to the two speakers 11FL and 11FR of the television receiver 1 are now additionally supplied to the two speakers 11SW1 and 11SW2. There is no change in the audio signals in the rear-left and rear-right channels.

In this case, instead of being supplied to the two speakers 11SW1 and 11SW2 without being changed, the audio signals that had been supplied to the two speakers 11FL and 11FR of the television receiver 1 are subjected to a so-called "virtual sound source operation" such that, when the user (listener) 4 listens to sound reproduced from the audio signals by the speakers 11SW1 and 11SW2 through the ears on the head, the sound is heard as if it were output from the two speakers 11FL and 11FR of the television receiver 1, and the processed audio signals are then supplied to the speakers 11SW1 and 11SW2.

Exemplary Speaker Placement of First Embodiment

Figure 2:
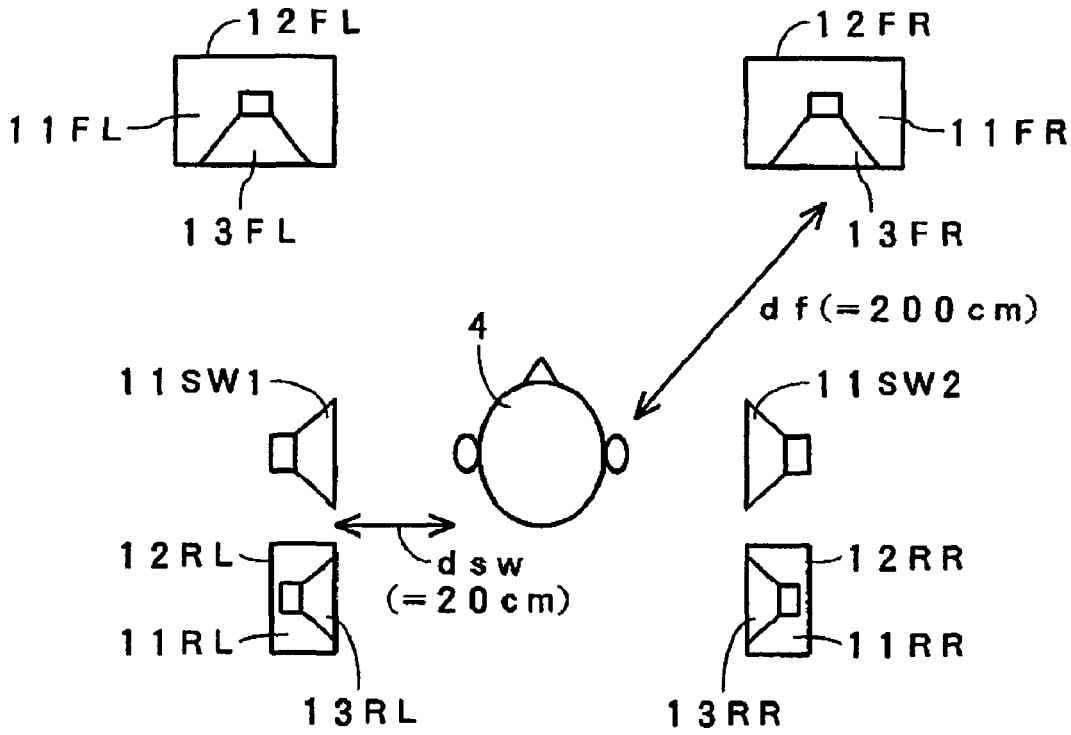
FIG. 2 is a diagram for illustrating an exemplary speaker placement according to the first embodiment.

Next, FIG. 2 illustrates an exemplary speaker placement in the audio reproducing system according to the first embodiment described above.

As shown in FIG. 2, the front-left channel speaker 11FL is placed at the left, and the front-right channel speaker 11FR is placed at the right in front of the listener 4 in the first embodiment.

These speakers 11FL and 11FR are included in the television receiver 1 in this example. Thus, the speakers 11FL and 11FR are constructed by mounting speaker units 13FL and 13FR at, for example, the front (serving as baffles) of small speaker boxes 12FL and 12FR (e.g., front panels of the television receiver). The speakers 11FL and 11FR are referred to as "front speakers" when it is unnecessary to distinguish channels.

The rear-left channel speaker 11RL is placed at the left, and the rear-right channel speaker 11RR is placed at the right behind the listener 4. These speakers 11RL and 11RR are referred to as "rear speakers" when it is unnecessary to distinguish between left and right.

In this example, these rear speakers 11RL and 11RR are constructed by mounting speaker units 13RL and 13RR at the front (serving as baffles) of speaker boxes 12RL and 12RR, which are smaller than the front speakers 11FL and 11FR.

Thus, the two front channel speakers 11FL and 11FR and the two rear channel speakers 11RL and 11RR may be constructed and placed similarly to those in a previously known speaker system. In the first embodiment, the structure of the subwoofers is greatly different from that in the known case.

That is, in the first embodiment, the two subwoofers 11SW1 and 11SW2 are placed near the left and right ears of the listener 4 with the head of the listener 4 sandwiched therebetween so that diaphragms thereof face the ears, respectively. The two subwoofers 11SW1 and 11SW2 are constructed such that their speaker units are not housed in speaker boxes nor are they mounted on baffles so that sounds emitted from the front and back of the diaphragms of the speaker units can be mixed.

A low-frequency audio signal for the LFE channel is commonly supplied to the two subwoofers 11SW1 and 11SW2, and low-frequency sounds in the LFE channel are output in phase from the subwoofers 11SW1 and 11SW2.

As a result of the aforementioned structure, low-frequency sounds in the LFE channel are output near the ears of the listener 4, and hence sound at high volume is heard by the listener 4. However, almost no sound is heard at places away from the listener 4 since sounds output from the front and back of the diaphragms of the speaker units of the subwoofers 11SW1 and 11SW2 are different in phase by 180 degrees and hence cancel out each other. Accordingly, unlike in a previously known speaker system, low-frequency sounds are prevented from propagating to its neighbors to bother them.

Figure 3:
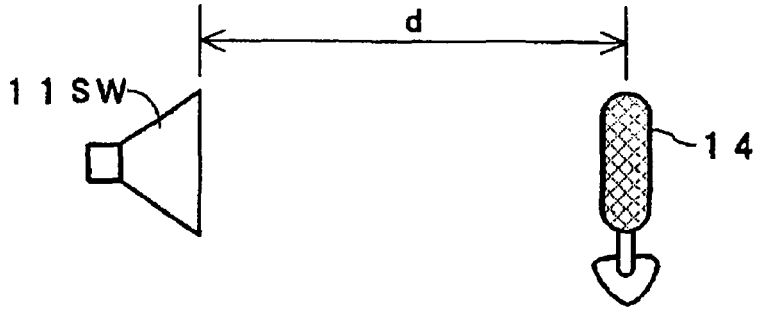
FIG. 3 is a diagram for illustrating the exemplary speaker placement according to the first embodiment.
Figure 4:
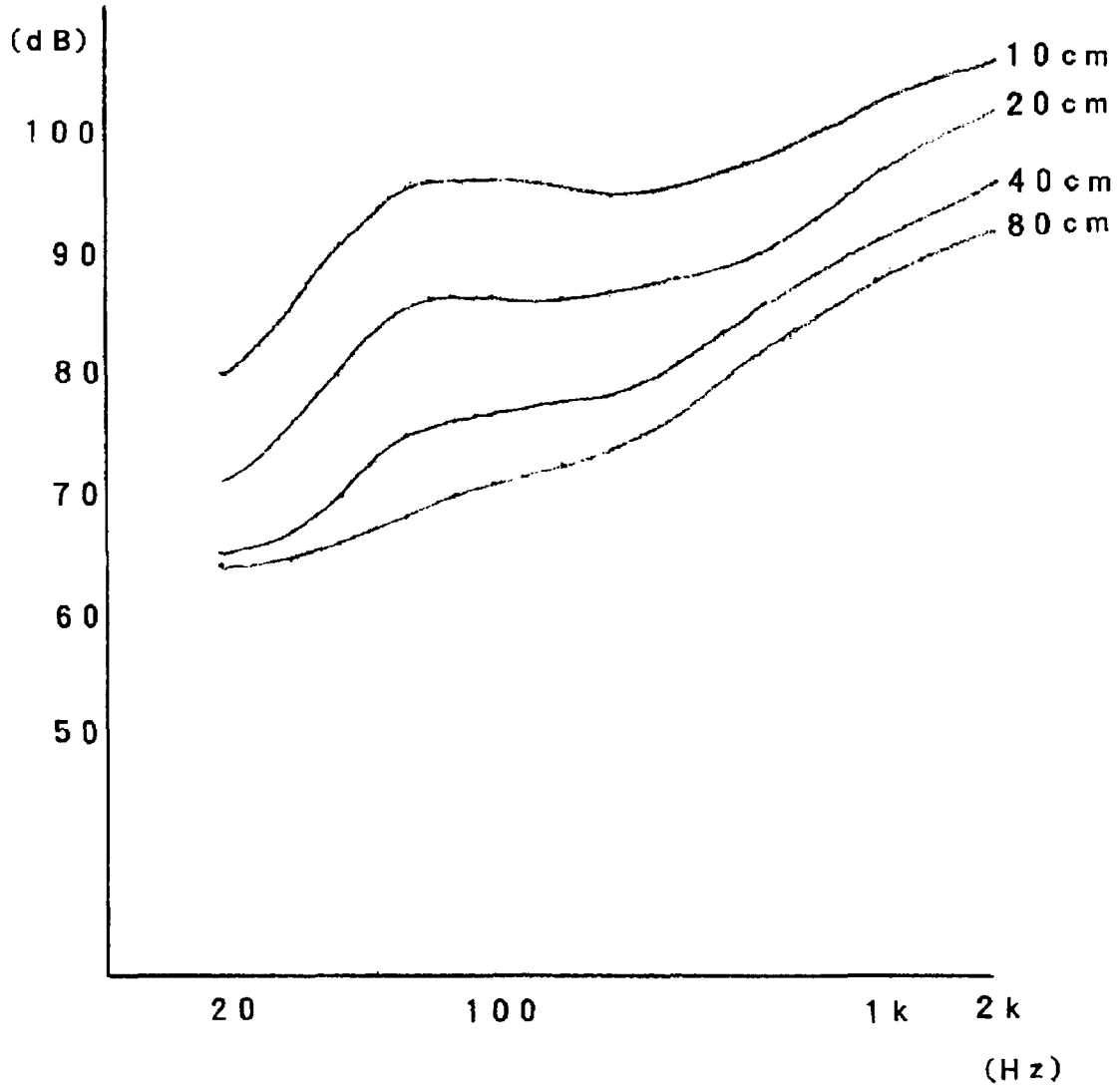
FIG. 4 is a graph for illustrating effects achieved by the exemplary speaker placement according to the first embodiment.

To make sure that low-frequency sounds are attenuated, as shown in FIG. 3, sound output in an anechoic chamber from a subwoofer speaker unit 11SW with a diameter of, for example, 17 cm is collected by a microphone 14 at a distance d from the speaker unit 11SW, and frequency characteristics of sound pressure level are measured, the results of which are shown in FIG. 4. In this case, the speaker unit 11SW is not housed in a box nor is it mounted on a baffle.

Four frequency characteristic curves shown in FIG. 4 are obtained when the distance d between the speaker unit 11SW and the microphone 14 is 10 cm, 20 cm, 40 cm, and 80 cm, respectively.

It is confirmed from FIG. 4 that, when a speaker unit is not housed in a box, sound less than or equal to 1 kHz is greatly attenuated. In particular, the lower the frequency of sound, the higher the attenuation.

In the first embodiment, the distance dsw between the two subwoofers 11SW1 and 11SW2 and the left and right ears, respectively, of the listener 4 is set to a distance at which low-frequency sounds are transmitted to the ears of the listener 4 without much attenuation. In this example, dsw is about 20 cm.

For example, in contrast to the general placement in which the distance between the subwoofer 11SW and the listener 4 is 2 m, when the distance between the subwoofers 11SW1 and 11SW2 and the ears, respectively, of the listener 4 in the first embodiment shown in FIG. 1 is set to 20 cm, the distance is one-tenth of the distance in the general placement.

Thus, energy necessary for the listener 4 to feel the same sound pressure in the first embodiment can be one-hundredth of that in the aforementioned general placement. In other words, if a 100-W amplifier is necessary in the aforementioned general placement, the same level of sound pressure can be felt using a 1-W amplifier in the first embodiment.

In the first embodiment, sound diffusion is less due to differences in audio signal output supplied to the speakers. Furthermore, bass sounds at, for example, 20 Hz, 30 Hz, and 40 Hz cancel out each other due to phase factors, and sound is hardly heard except in the immediate vicinity of the subwoofer speaker units. In contrast, dynamic sound effects included in DVD software are achieved by recording high energy in these bass frequency bands. Accordingly, a better soundproofing effect can be provided.

With the aforementioned structure, a sufficient effect can be achieved in the case of attenuation of low-frequency sound. Similarly, when sounds other than low-frequency sound are reproduced and output by the speakers 11SW1 and 11SW2, a soundproofing effect similar to the aforementioned effect can be achieved.

In the first embodiment, besides the subwoofer speakers, the rear-left and rear-right channel speakers are placed at short distances to the ears of the listener 4, thereby reducing energy emitted in those frequencies, which contributes to soundproofing.

That is, it is advantageous to place the rear speakers 11RL and 11RR next to the subwoofers 11SW1 and 11SW2 in the vicinity of the ears of the listener 4. Since the rear speakers 11RL and 11RR use reverberant sound coming from the back of the listener 4 as their main sound source, the rear speakers 11RL and 11RR are not so important. By housing small speaker units of the rear speakers 11RL and 11RR in small speaker boxes and placing them at the left and right behind the head of the listener 4, localization and energy saving can be achieved.

In the aforementioned example, the sound pressure of the subwoofers 11SW1 and 11SW2 is reduced by 20 dB by reducing the distance dsw between the subwoofers 11SW1 and 11SW2 and the ears of the listener 4 to 20 cm, compared with the general case of 2 m. The same applies to the rear speakers 11RL and 11RR.

An exemplary speaker placement taking the above into consideration is such that, for example, the speakers are mounted on a chair structured as, for example, a massage chair.

Figure 5:
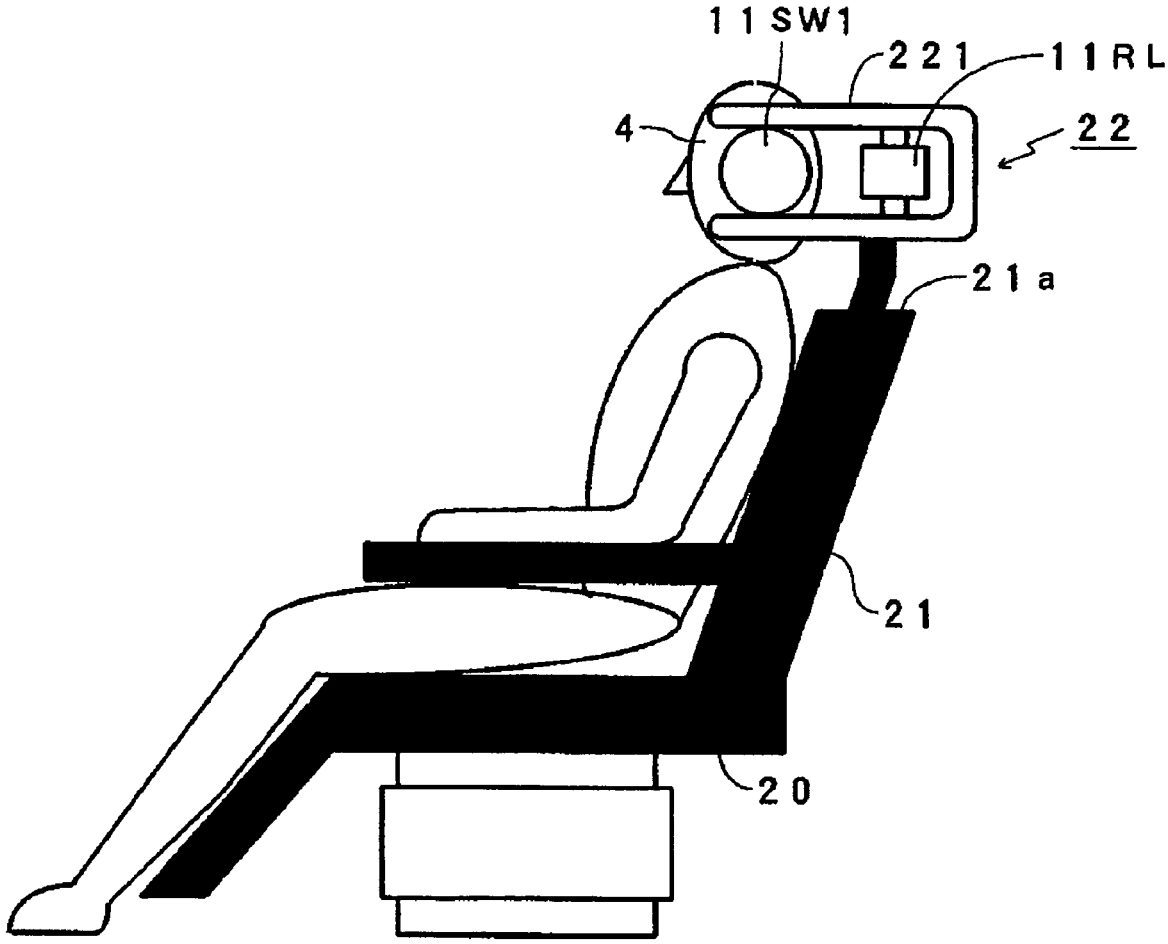
FIG. 5 is a diagram for illustrating an exemplary speaker placement according to the first embodiment.

FIG. 5 shows such an example in which the above-described speakers 11RL, 11RR, 11SW1, and 11SW2 are mounted on a chair.

That is, in this example, a chair 20 is structured as, for example, a seat in business class on airplane. A speaker holder 22 is attached to an apex 21*a* of a back portion 21 of the chair 20. The subwoofers 11SW1 and 11SW2 and the rear speakers 11RL and 11RR are mounted on the speaker holder 22 and held in place.

Figure 6A:
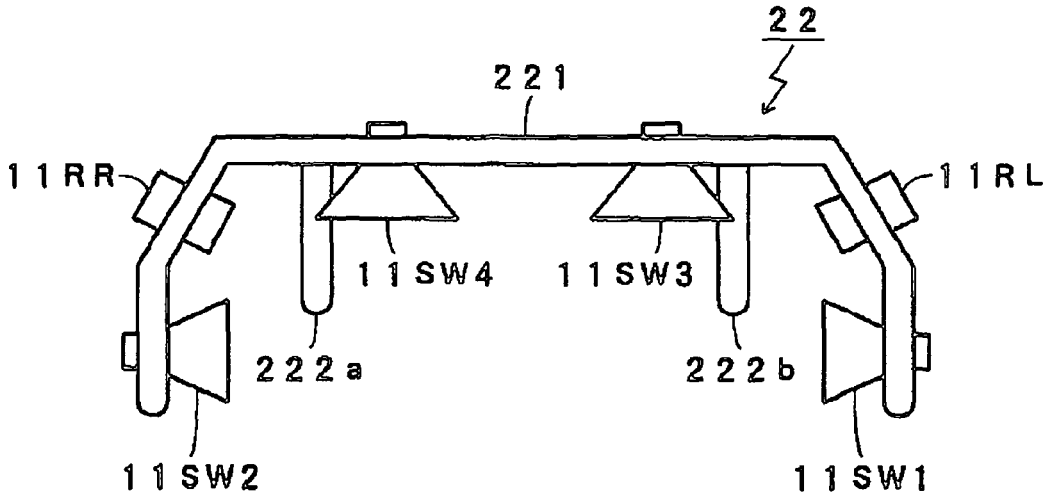
FIGS. 6A and 6B are diagrams for illustrating the exemplary speaker placement according to the first embodiment.
Figure 6B:
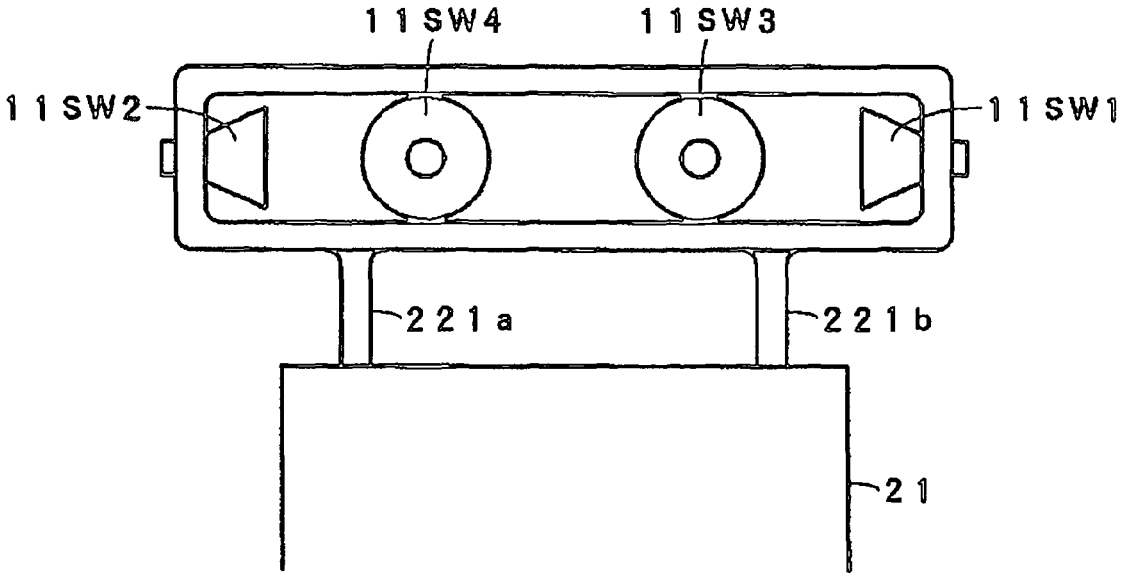

FIGS. 6A and 6B show an example of the speaker holder 22. The speaker holder 22 has a pipe 221 made of metal such as aluminum. As shown in FIG. 6B, the pipe 221 has a flat ring shape, and the subwoofers 11SW1 and 11SW2, the rear speakers 11RL and 11RR, and additional auxiliary subwoofers 11SW3 and 11SW4 are fixedly held in a space defined by the ring.

Since the subwoofers 11SW1 and 11SW2 placed next to the ears of the listener 4 may sound lacking power in providing dynamic low-frequency sound, the auxiliary subwoofers 11SW3 and 11SW4 are used to support the insufficient power. Thus, these auxiliary subwoofers 11SW3 and 11SW4 are not indispensable.

In the first embodiment, only a low-frequency audio signal (LFE signal) is supplied to the auxiliary subwoofers 11SW3 and 11SW4. Alternatively, when there is no sound output from the speakers 11FL and 11FR, the audio signals subjected to a virtual sound source operation may be similarly supplied to the auxiliary subwoofers 11SW3 and 11SW4, as in the subwoofers 11SW1 and 11SW2.

The pipe 221 has a flat ring shape. As shown in FIG. 6A, the ring portion has a substantially L shape surrounding the sides of the head except for the front of the face of the listener 4 (the sides facing the left and right ears) and the back of the head.

The ring pipe 221 has fixture legs 222*a* and 222*b* attached thereto to be fixed to the back portion 21 of the chair 20. The fixture legs 222*a* and 222*b* allow, for example, removal attachment to the back portion 21 of the chair 20. That is, the apex 21*a* of the back portion 21 of the chair 20 has slots (not shown) into which the fixture legs 222*a* and 222*b* are inserted and engaged. By inserting the fixture legs 222*a* and 222*b* into the slots of the back portion 21 so that the fixture legs 222*a* and 222*b* are engaged therewith, the pipe 221 is fixed to the back portion 21.

Of the ring pipe 221 having an L shape, at positions facing the left and right ears of the listener 4 when the listener 4 sits in the chair 20, the subwoofers 11SW1 and 11SW2 are fixed to the pipe 221 and held in place. Behind the subwoofers 11SW1 and 11SW2, the rear speakers 11RL and 11RR whose speaker units are housed in boxes are fixed to the pipe 221 and held in place. At positions on the ring pipe 221 behind the head of the listener 4, the auxiliary subwoofers 11SW3 and 11SW4 are fixed to the pipe 221 and held in place.

In this example, when the listener 4 sits in the chair 20, the distances between the subwoofers 11SW1 to 11SW4 and the rear speakers 11RL and 11RR and the head (particularly the ears) of the listener 4 are set to about 20 cm.

In this example, associated-channel audio signals to the speakers 11FL, 11FR, 11RL, 11RR, and 11SW1 to 11SW4 are supplied from the audio signal output device 3 via associated signal lines (speaker cables).

Exemplary Structure of Audio Signal Output Device 3

Figure 7:
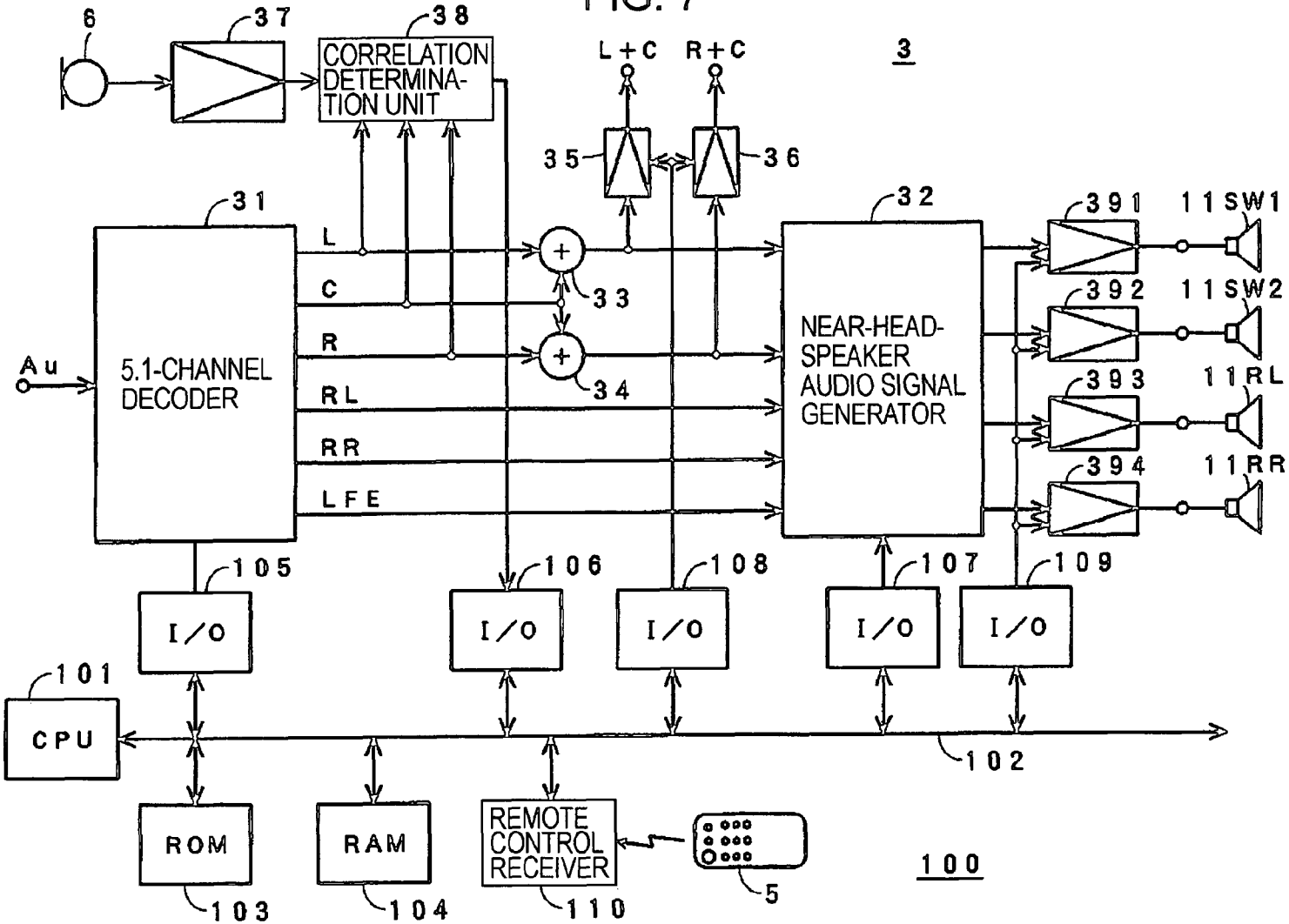
FIG. 7 is a block diagram showing an exemplary structure of an audio signal output device according to the first embodiment.

FIG. 7 is a block diagram of an exemplary structure of the audio signal output device 3 according to the first embodiment. The audio signal output device 3 in this example has a 5.1-channel decoder 31, a near-head-speaker audio signal generator 32, and a controller 100 including a microcomputer.

The controller 100 includes a read only memory (ROM) 103 storing software programs or the like, a random access memory (RAM) 104 serving as a work area, a plurality of input/output ports 105 to 109, and a remote control receiver 110 for receiving a remote control signal from the remote commander 5, which are connected to a central processing unit (CPU) 101 via a system bus 102.

The 5.1-channel decoder 31 receives the audio signal Au from the DVD player 2, channel-decodes the audio signal Au, and outputs front-left and front-right channel audio signals L and R, a center channel audio signal C, rear-left and rear-right channel audio signals RL and RR, and a low-frequency audio signal LFE.

The front-left channel audio signal L and the center channel audio signal C from the 5.1-channel decoder 31 are supplied to a synthesizer 33. The synthesizer 33 combines the supplied signals L and C and outputs a combined output audio signal (L+C) via an amplifier 35 to one speaker 11FL of the television receiver 1 and to the near-head-speaker audio signal generator 32.

The front-right channel audio signal R and the center channel audio signal C from the 5.1-channel decoder 31 are supplied to a synthesizer 34. The synthesizer 34 combines the supplied signals R and C and outputs a combined output audio signal (R+C) via an amplifier 36 to the other speaker 11FR of the television receiver 1 and to the near-head-speaker audio signal generator 32.

The amplifiers 35 and 36 have a muting function of cutting off the audio signal output. When the remote control receiver 110 receives a mute signal from the remote commander 5, a muting control signal is supplied to the amplifiers 35 and 36 via the input/output port 108. Accordingly, the amplifiers 35 and 36 are muted, and the supply of the front-left and front-right channel audio signals added with the center channel audio signal to the speakers 11FL and 11FR is cut off.

A collected sound signal obtained by the microphone 6 is supplied via an amplifier 37 to the correlation determination unit 38. Additionally, the signals supplied to the speakers 11FL and 11FR, namely, the front-left and front-right channel audio signals L and R, and the center channel audio signal C, are supplied to the correlation determination unit 38. Alternatively, the audio signals output from the synthesizers 33 and 34 may be supplied to the correlation determination unit 38.

The correlation determination unit 38 performs a correlation operation of the audio signal collected and obtained by the microphone 6 with the front-left and front-right channel audio signals L and R and the center channel audio signal C from the 5.1-channel decoder 31 and, on the basis of the operation result, generates a correlation determination result output indicating whether the two signals correlate with each other. The correlation determination unit 38 supplies the correlation determination result output via the input/output port 106 to the controller 100.

Alternatively, the correlation determination unit 38 may be implemented by software processing in the controller 100.

In the first embodiment, detection performed by the aforementioned audio detectors is performed by the CPU 101 executing software on the basis of a software program stored in the ROM 103 using the RAM 104 as a work area, using the correlation determination result output from the correlation determination unit 38 and the remote control signal such as the mute signal from the remote control receiver 110.

Next, besides the combined audio signals from the synthesizers 33 and 34, the rear-left and rear-right channel audio signals RL and RR and the low-frequency audio signal LFE are supplied to the near-head-speaker audio signal generator 32.

The near-head-speaker audio signal generator 32 is controlled by a switching control signal supplied via the input/output port 107 of the controller 100 such that the audio signals supplied to the speakers 11SW1 and 11SW2 are switched between the state in which sound is output from the speakers 11FL and 11FR of the television receiver 1 and the state in which no sound is output from the speakers 11FL and 11FR of the television receiver 1.

Figure 8:
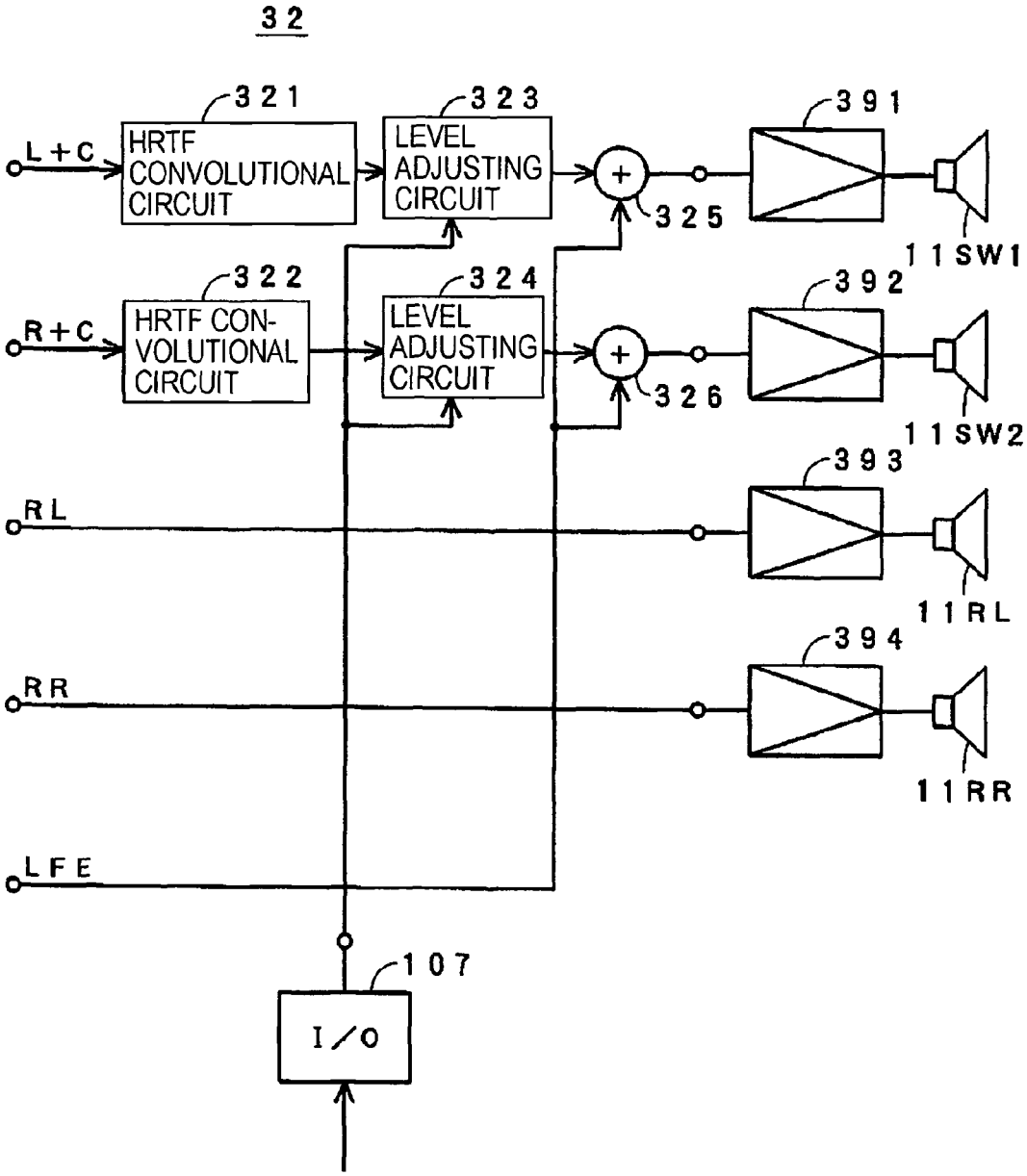
FIG. 8 is a block diagram showing an exemplary detailed structure of part of the audio signal output device shown in FIG. 7.

FIG. 8 shows an exemplary structure of the near-head-speaker audio signal generator 32 according to the first embodiment.

As has been described above, only the low-frequency audio signal LFE is supplied to the auxiliary subwoofers 11SW3 and 11SW4. To avoid complexity in the description, an audio signal supply system to the auxiliary subwoofers 11SW3 and 11SW4 is omitted in FIGS. 7 and 8.

In the near-head-speaker audio signal generator 32, the combined signal of the front-left channel audio signal L and the center channel audio signal C from the synthesizer 33 is supplied to a head related transfer function (HRTF) convolutional circuit 321. The combined signal of the front-right channel audio signal R and the center channel audio signal C from the synthesizer 34 is supplied to an HRTF convolutional circuit 322.

The HRTF convolutional circuits 321 and 322 use, for example, digital filtering to convolute HRTFs prepared in advance with the combined signal of the front-left channel audio signal L and the center channel audio signal C from the synthesizer 33 and the combined signal of the front-right channel audio signal R and the center channel audio signal C from the synthesizer 34, respectively.

Thus, in the HRTF convolutional circuits 321 and 322, the input audio signals are converted to digital signals, which in turn are convoluted with the HRTFs and then reconverted into analog signals to be output.

Figure 9:
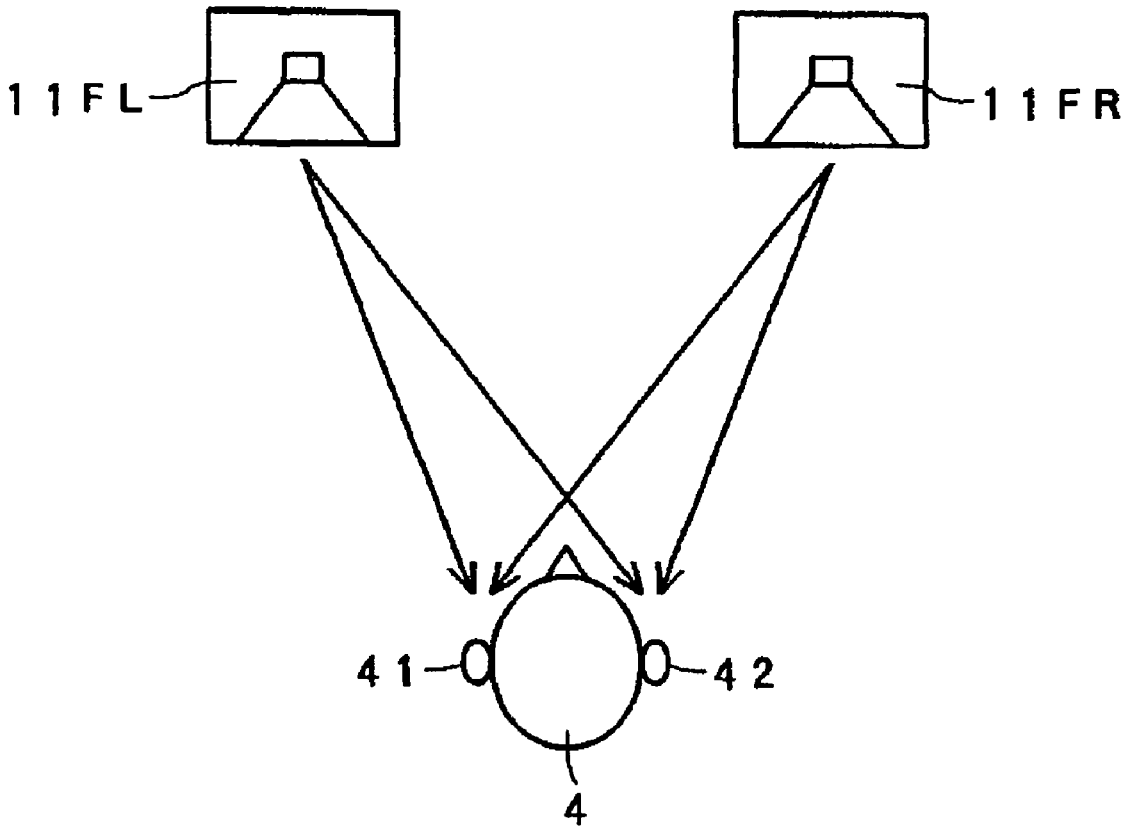
FIG. 9 is a diagram for illustrating the example shown in FIG. 8.

The HRTFs are prepared in advance in this example in the following manner. FIG. 9 illustrates a method of measuring the HRTFs.

That is, as shown in FIG. 9, a left-channel measuring microphone 41 and a right-channel measuring microphone 42 are placed near the left and right ears of the listener 4. Next, for example, sound output generated by reproducing an impulse by the left channel speaker 11FL is collected by the microphones 41 and 42, and, on the basis of the collected audio signals, the transfer functions from the speaker 11FL to the left and right ears (a pair of HRTFs for the front-left channel) are measured.

Similarly, for example, sound output generated by reproducing an impulse by the right channel speaker 11FR is collected by the microphones 41 and 42, and, on the basis of the collected audio signals, the transfer functions from the speaker 11FR to the left and right ears (a pair of HRTFs for the front-right channel) are measured.

The above-described measurement method assumes the speakers 11FL and 11FR of the television receiver 1 and intends to achieve virtual sound from the speakers 11FL and 11FR. However, the speakers 11FL and 11FR may not be necessarily used.

For example, the transfer functions from each of the speakers to the ears in the case where the speakers are placed 2 m at the left and right at 30 degrees from the front center of the listener 4 are measured, and the obtained transfer functions may be convoluted in the HRTF convolutional circuits 321 and 322.

Alternatively, the audio reproducing system of the first embodiment may include the microphones 41 and 42 and may have a function of measuring the transfer functions in the speaker placement of the actual audio reproducing system.

The HRTFs measured in this manner are convoluted in the HRTF convolutional circuits 321 and 322. The HRTF convolutional circuits 321 and 322, which are simplified in FIG. 8 to avoid complexity in the drawing, output audio signals to be supplied to the speakers 11SW1 and 11SW2, respectively. Accordingly, when the audio signals from the HRTF convolutional circuits 321 and 322 are supplied to the speakers 11SW1 and 11SW2 placed near the ears and sound is reproduced, the listener 4 hears the reproduced sound as if it were output from the left and right speakers 11FL and 11FR.

The levels of the front-left and front-right channel audio signals may be lower than the levels of signals supplied to the speakers 11FL and 11FR because the speakers 11SW1 and 11SW2 are near the ears of the listener 4.

With the above-described HRTF convolution, sound is heard as if it were output from virtual speaker positions. This is referred to as a "virtual sound source operation" in the specification.

The audio signals from the HRTF convolutional circuits 321 and 322, which are subjected to a virtual sound source operation in the above-described manner, are supplied via level adjusting circuits 323 and 324 to synthesizers 325 and 326, respectively.

A level adjustment control signal is supplied from the input/output port 107 of the controller 100 to the level adjusting circuits 323 and 324. In this example, the level adjustment control signal provides a switching control operation allowing or not allowing the audio signals from the HRTF convolutional circuits 321 and 322 to be supplied to the synthesizers 325 and 326.

The low-frequency audio signal LFE is supplied from the 5.1-channel decoder 31 to the synthesizers 325 and 326. Audio signals output from the synthesizers 325 and 326 are supplied via amplifiers 391 and 392 to the speakers 11SW1 and 11SW2, respectively, which are placed near the ears of the listener 4.

In this example, the rear-left and rear-right channel audio signals RL and RR pass through the near-head-speaker audio signal generator 32 and are supplied via amplifiers 393 and 394 to the rear-left and rear-right speakers 11RL and 11RR, respectively.

In the first embodiment, the audio signal output device 3 has a sound saving mode and a normal mode. In the sound saving mode, audio signals to be supplied to the speakers 11SW1 and 11SW2 placed near the ears of the listener 4 are changed according to the detection result output of the audio detector. In the normal mode, the detection result output of the audio detector is ignored, and sound is reproduced without changing audio signals to be supplied to the speakers 11SW1 and 11SW2.

When a mute signal serving as a remote control signal from the remote commander 5 is received in the normal mode, the audio signal output device 3 stops all audio signal output (muting control).

As in the amplifiers 35 and 36, the amplifiers 391, 392, 393, and 394 have a muting function of cutting off audio signal output. When the remote control receiver 110 receives a mute signal from the remote commander 5 in the normal mode, a muting control signal is supplied via the input/output port 109 to the amplifiers 391, 392, 393, and 394, thereby muting the amplifiers 391, 392, 393, and 394. Thus, the supply of audio signals to the speakers 11SW1, 11SW2, 11RL, and 11RR is cut off.

In the sound saving mode, however, even when the remote control receiver 110 receives a mute signal from the remote commander 5, the controller 100 does not supply a muting control signal to the amplifiers 391, 392, 393, and 394. As has been described above, audio signals output from the near-head-speaker audio signal generator 32 are switched.

When the remote control receiver 110 of the controller 100 receives a mute signal from the remote commander 5, the controller 100 supplies a muting control signal to the amplifiers 35 and 36 to cut off audio signal output both in the normal mode and in the sound saving mode.

Next, the operation of the audio signal output device 3 according to the first embodiment in the sound saving mode will be described further with reference to the flowcharts of FIGS. 10 and 11.

To simplify the description, an audio mode in which only the low-frequency audio signal LFE is output from the speakers 11SW1 and 11SW2 is referred to as "audio mode 1", and an audio mode in which, besides the low-frequency audio signal LFE, the front-left and front-right channel signals subjected to a virtual sound source operation are output from the speakers 11SW1 and 11SW2 will be referred to as "audio mode 2".

In audio mode 1, the following sounds are output from the associated speakers:

front-left channel sound and front-right channel sound are output from the speakers 11FL and 11FR;

rear-left channel sound and rear-right channel sound are output from the speakers 11RL and 11RR; and low-frequency sound is output from the speakers 11SW1 and 11SW2.

In audio mode 2, there is no sound output from the speakers 11FL and 11FR, and the following sounds are output from the associated speakers:

rear-left channel sound and rear-right channel sound are output from the speakers 11RL and 11RR; and low-frequency sound, and front-left channel sound and front-right channel sound subjected to virtual sound source operation are output from the speakers 11SW1 and 11SW2.

Figure 10:
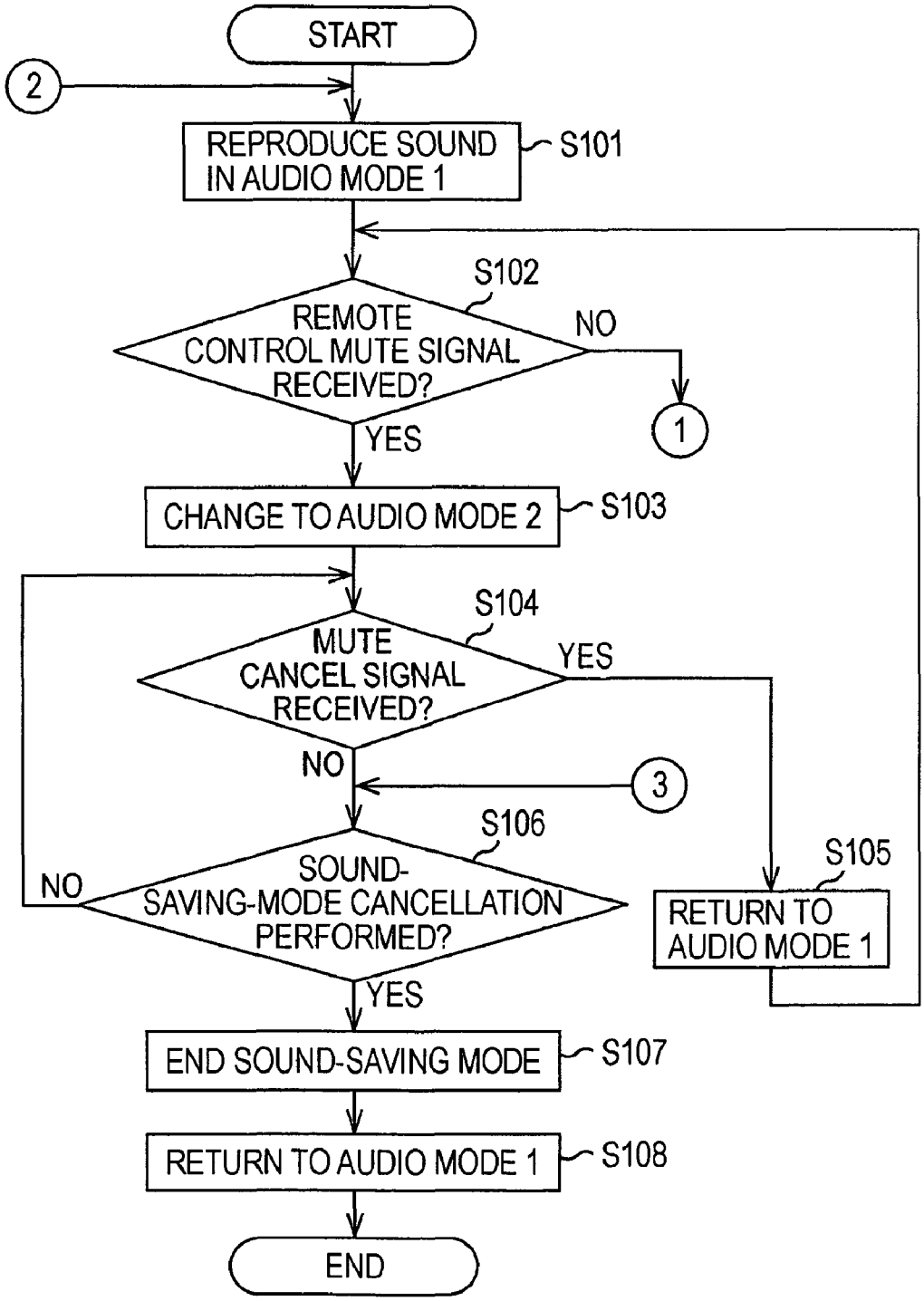
FIG. 10 is a flowchart for illustrating part of an exemplary processing operation according to the first embodiment.

As shown in FIG. 10, in the sound saving mode, the audio signal output device 3 initially reproduces sound from an audio signal from the DVD player 2 in audio mode 1 (step S101). Here, the CPU 101 supplies a control signal serving as a level adjustment control signal supplied from the input/output port 109 to the level adjusting circuits 323 and 324 so that the audio signals from the HRTF convolutional circuits 321 and 322 are not supplied to the amplifiers 391 and 392. Thus, only the low-frequency audio signal LFE is supplied to the speakers 11SW1 and 11SW2, and sound is reproduced.

In this state, the CPU 101 determines whether reception of a mute signal serving as a remote control signal is detected (step S102). If reception of a mute signal serving as a remote control signal is detected, the CPU 101 changes the audio mode from audio mode 1 to audio mode 2 (step S103).

In audio mode 2, the CPU 101 supplies a muting control signal via the input/output port 108 to the amplifiers 35 and 36 to stop the supply of audio signals to the speakers 11FL and 11FR. At the same time, the CPU 101 supplies a level adjustment control signal via the input/output port 109 to the level adjusting circuits 323 and 324 so that, besides the low-frequency audio signal LFE, the front-left and front-right channel audio signals from the HRTF convolutional circuits 321 and 322, which are subjected to a virtual sound source operation, are supplied to the speakers 11SW1 and 11SW2.

Next, the CPU 101 determines whether a mute cancel signal serving as a remote control signal is received (step S104). If it is determined that a mute cancel signal is received, the CPU 101 returns the audio mode to audio mode 1 (step S105). Thereafter, the flow returns to step S102, and the operation from step S102 onward is repeated.

If it is determined in step S104 that no mute cancel signal is received, the CPU 101 determines whether a sound-saving-mode cancellation signal serving as a remote control signal is received (step S106). If it is determined that no sound-saving-mode cancellation signal serving as a remote control signal is received, the flow returns to step S104, and the operation from step S104 onward is repeated.

If it is determined in step S106 that a sound-saving-mode cancellation signal serving as a remote control signal is received, the CPU 101 ends the sound saving mode (step S107) and returns the audio mode to audio mode 1 (step S108). The operation in the sound saving mode ends here.

Figure 11:
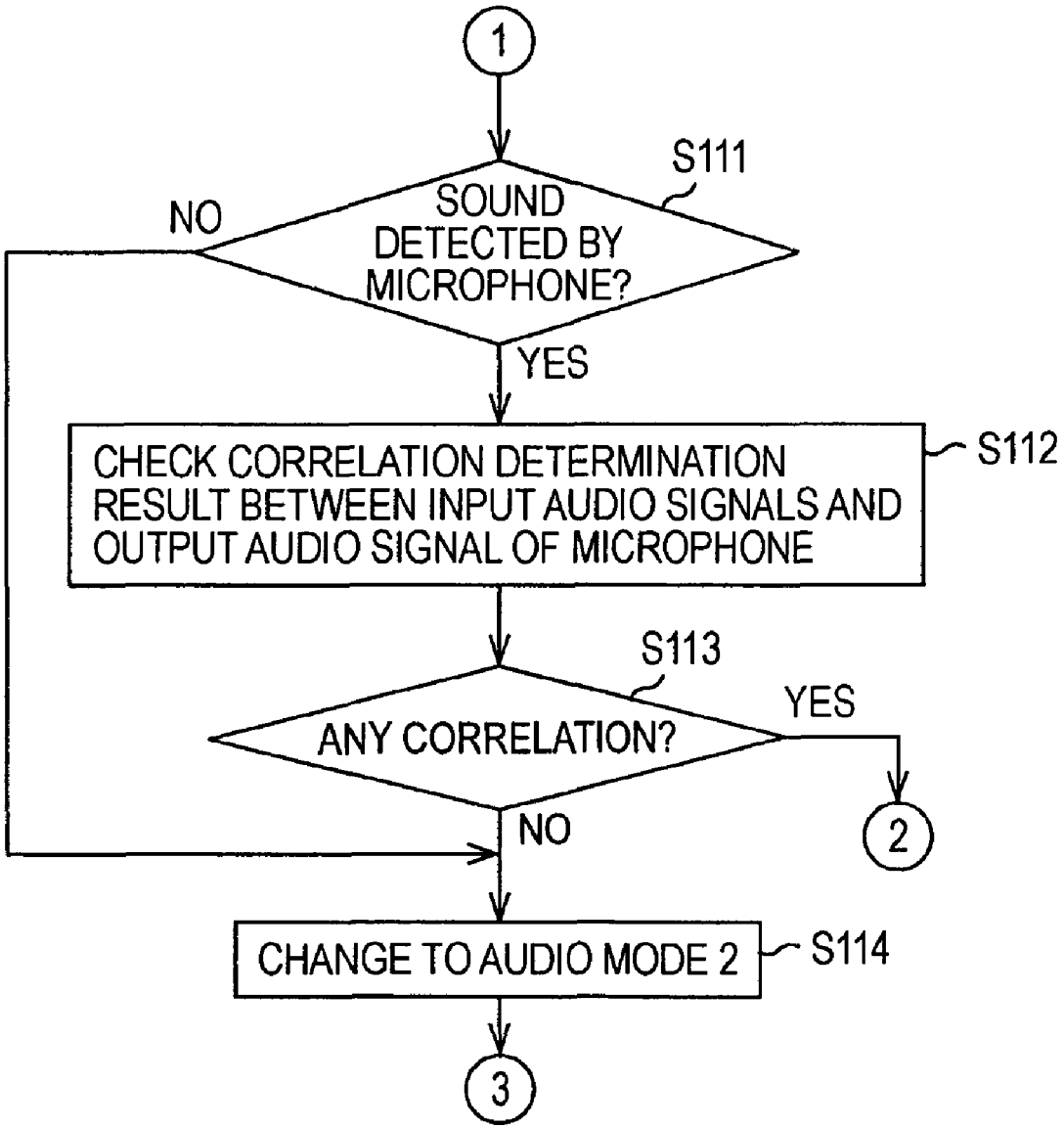
FIG. 11 is a flowchart for illustrating part of the exemplary processing operation according to the first embodiment.

If it is determined in step S102 that reception of a mute signal serving as a remote control signal is not detected, the CPU 101 determines whether there is an audio signal from the microphone 6 (step S111 in FIG. 11). The determination in step S111 is performed by a level detector (not shown in FIG. 7) for detecting the level of an audio signal from the amplifier 37, and output of the level detector is input to the controller 100 via an input/output port.

If it is detected in step S111 that there is no audio signal from the microphone 6, the CPU 101 determines that there is no sound output from the speakers 11FL and 11FR and changes the audio mode to audio mode 2 (step S114). Thereafter, the flow jumps to step S106, and the operation from step S106 onward is repeated.

Taking into consideration that there may be silence in television sound, the presence of an audio signal from the microphone 6 is detected in step S111 in such a manner that, when silence continues for, for example, 15 seconds or longer, it is determined that there is no audio signal from the microphone 6. In this way, silence in television sound will not be detected.

If it is determined in step S111 that there is an audio signal from the microphone 6, the CPU 101 obtains and checks the correlation determination result output from the correlation determination unit 38 (step S112). The CPU 101 determines whether there is correlation (step S113). If it is determined that there is correlation, it is then determined that there is sound output from the speakers 11FL and 11FR, and the flow returns to step S101.

If it is determined in step S113 that there is no correlation, the CPU 101 determines that there is no sound output from the speakers 11FL and 11FR and changes the audio mode to audio mode 2 (step S114). Thereafter, the flow jumps to step S106, and the operation from step S106 onward is repeated.

With the aforementioned structure, when the speakers can be turned up relatively loud, such as during the day time, the speakers 11FL and 11FR of the television receiver 1 are turned up loud so that the user 4 can enjoy multi-channel audio reproduction or the like.

In contrast, during hours when loud sound becomes unpleasant noise and thus causes a problem, such as at night, the user 4 uses the remote commander 5 to turn on the sound saving mode and to perform a mute operation to turn down the volume to zero, thereby stopping sound output from the speakers 11FL and 11FR of the television receiver 1. At the same time, sound can be reproduced using the speakers 11SW1 and 11SW2 placed near the ears so that the same sound reproduction field as that during the day can be realized.

In this case, even when the audio signals supplied to the speakers 11SW1 and 11SW2 are of low levels, the reproduced sound volume is sufficient for the listener 4 since the sound is reproduced near the ears. Thus, the power consumption is reduced.

Second Embodiment

In the first embodiment described above, sound is reproduced from the rear-left and rear-right channel audio signals by the dedicated rear-left and rear-right channel speakers 11RL and 11RR placed near the ears of the listener 4. The audio signals to be reproduced by the rear-left and rear-right speakers 11RL and 11RR can be subjected to a virtual sound source operation, and sound can be reproduced using the speakers 11SW1 and 11SW2. The second embodiment describes an example in such a case.

Figure 12:
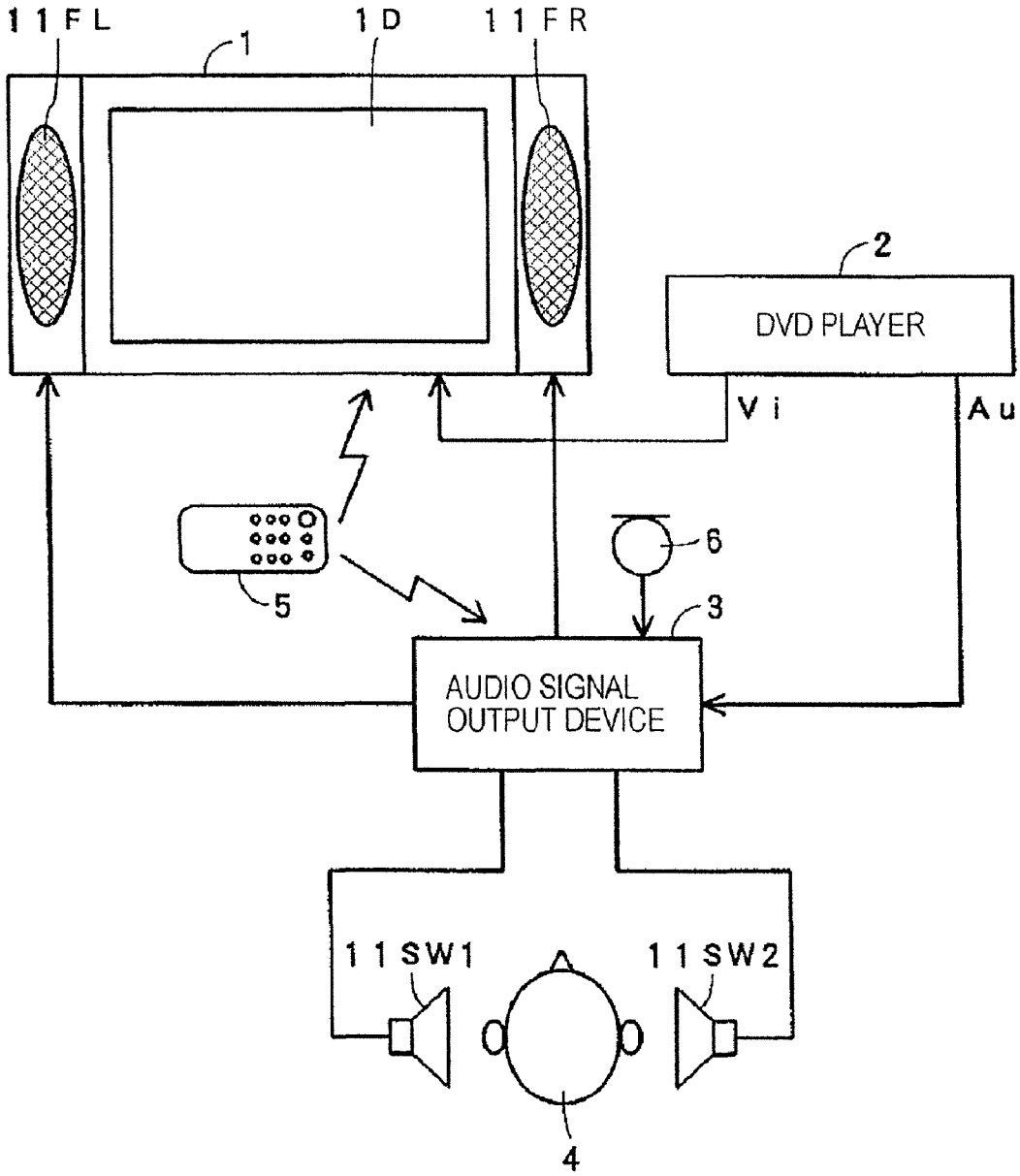
FIG. 12 is a diagram for illustrating the outline of an exemplary audio reproducing system using an audio reproducing apparatus according to a second embodiment of the present invention.

FIG. 12 shows the outline of an audio reproducing system including an audio reproducing apparatus according to the second embodiment. Compared with FIG. 1, there are no rear-left and rear-right speakers 11RL and 11RR in FIG. 12. The other portions in FIG. 12 are the same as those in FIG. 1.

Figure 13:
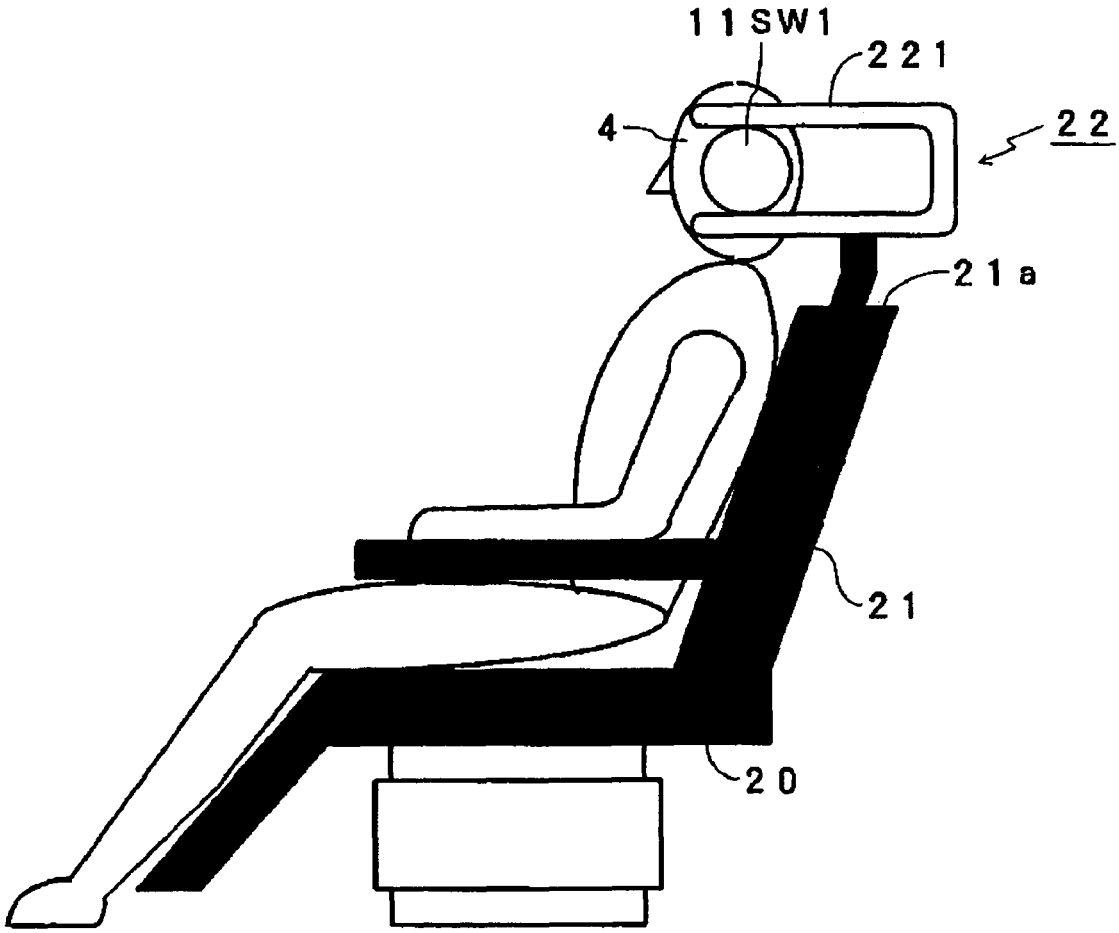
FIG. 13 is a diagram for illustrating an exemplary speaker placement according to the second embodiment.
Figure 14A:
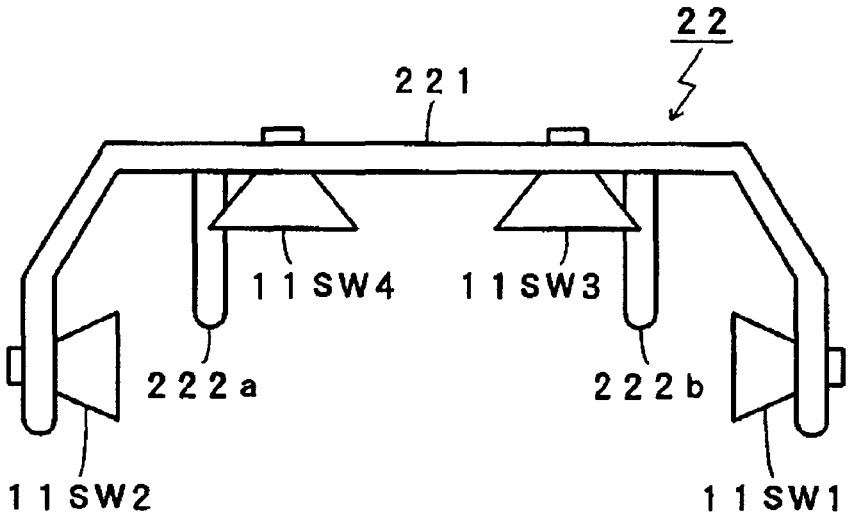
FIGS. 14A and 14B are diagrams for illustrating the exemplary speaker placement according to the second embodiment.
Figure 14B:
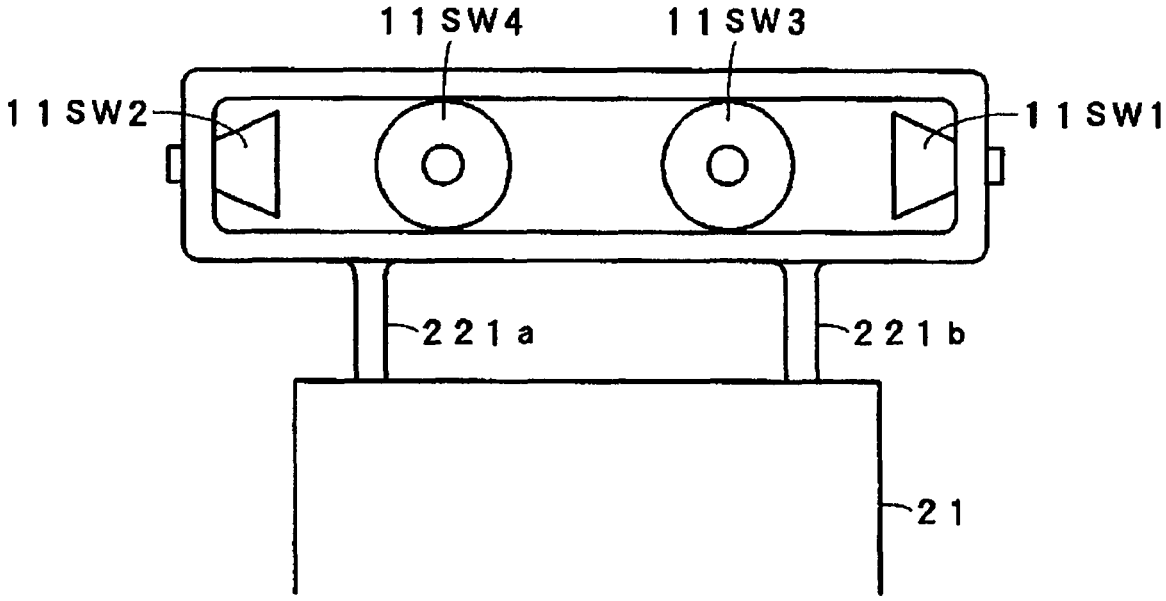

The speaker placement in the vicinity of the listener 4 in the second embodiment is such that, as shown in FIGS. 13, 14A, and 14B, the speakers near the ears of the listener 4 include only the speakers 11SW1 and 11SW2 and the auxiliary speakers 11SW3 and 11SW4, and the rear-left and rear-right channel speakers 11RL and 11RR are omitted.

Figure 15:
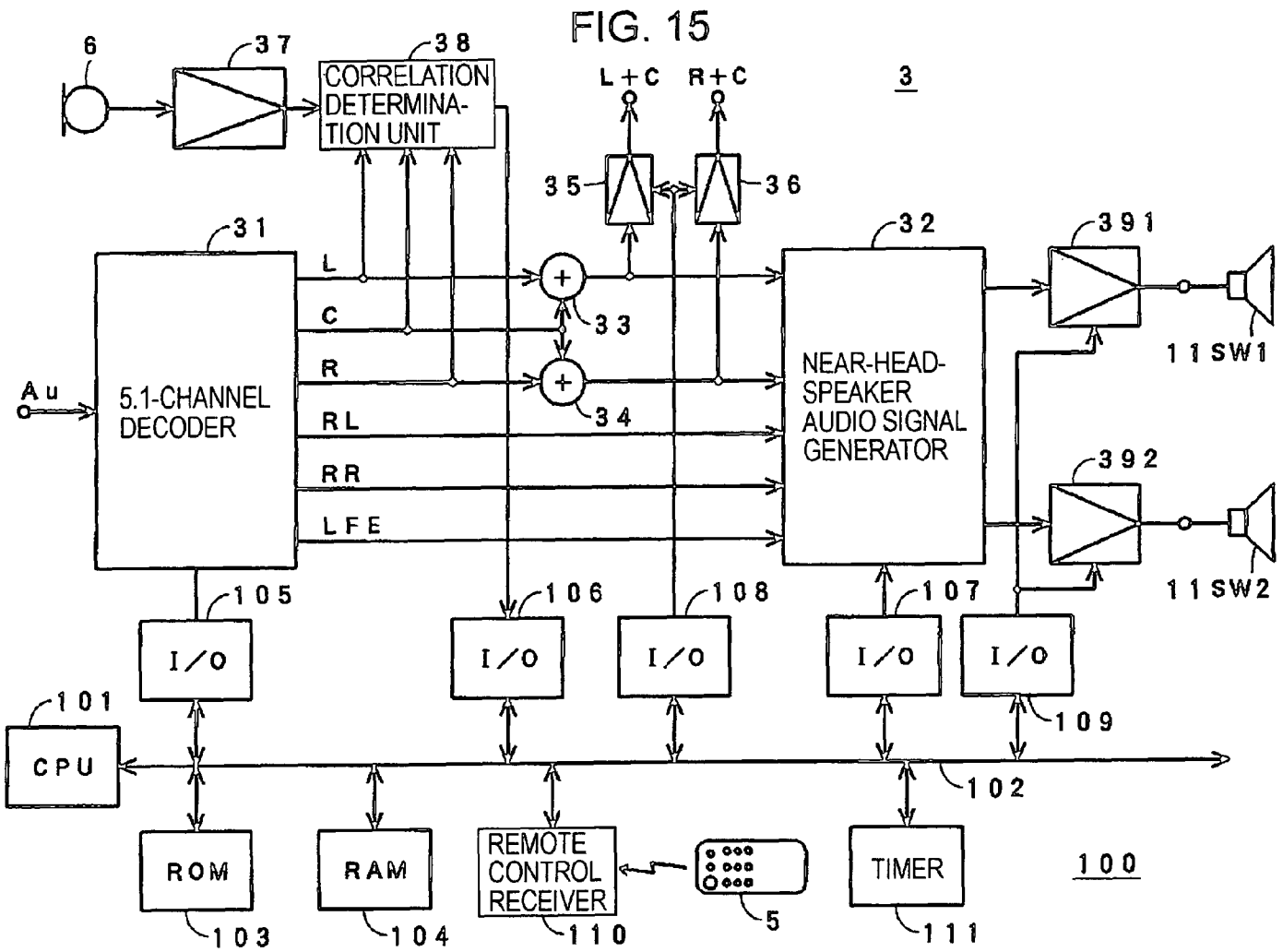
FIG. 15 is a block diagram showing an exemplary structure of an audio signal output device according to the second embodiment.

The structure of the audio signal output device 3 is shown in FIG. 15 and is different from that of the audio signal output device 3 in the first embodiment shown in FIG. 1 in that the near-head-speaker audio signal generator 32 generates only the audio signals for the speakers 11SW1 and 11SW2 and supplies these signals via the amplifiers 391 and 392 to the speakers 11SW1 and 11SW2.

Figure 16:
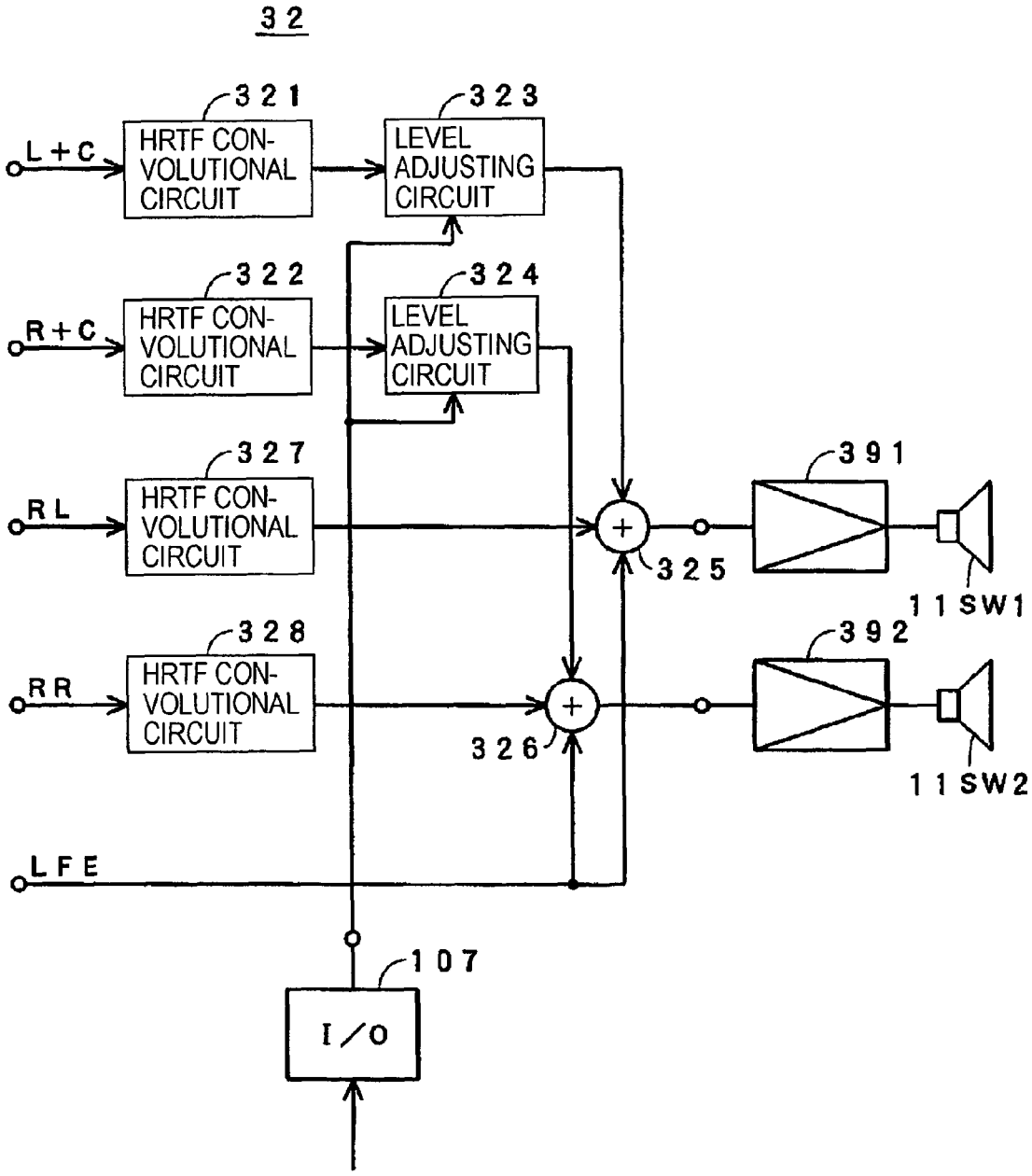
FIG. 16 is a block diagram showing an exemplary detailed structure of part of the audio signal output device shown in FIG. 15.

An exemplary structure of the near-head-speaker audio signal generator 32 of the audio signal output device 3 according to the second embodiment is shown in FIG. 16.

That is, according to the second embodiment, the rear-left and rear-right channel audio signals RL and RR are supplied to HRTF convolutional circuits 327 and 328. Transfer functions (HRTFs) from each of the rear speakers to the ears of the listener 4 are stored in advance in the HRTF convolutional circuits 327 and 328. The stored transfer functions are convoluted with the rear-left and rear-right channel audio signals RL and RR. The HRTF convolutional circuits 321, 322, 327, and 328, which are simplified in FIG. 16 to avoid complexity in the drawing, output audio signals to be supplied to the speakers 11SW1 and 11SW2.

The transfer functions from each of the rear-left and rear-right channel speakers to the ears of the listener 4 can be obtained in a manner similar to the case of the HRTF convolutional circuits 321 and 322 described with reference to FIG. 9. That is, impulse sound output from each of the rear speakers placed behind the listener 4 is collected by microphones placed near the ears of the listener 4, and the transfer functions between the rear speaker and the ears of the listener 4 are measured and obtained.

According to the second embodiment, the synthesizers 325 and 326 combine audio signals generated by subjecting the front-left and front-right channel audio signals from the HRTF convolutional circuits 321 and 322 via the level adjusting circuits 323 and 324 to a virtual sound source operation, audio signals generated by subjecting the rear-left and rear-right channel audio signals from the HRTF convolutional circuits 327 and 328 to a virtual sound source operation, and the low-frequency audio signal LFE. Combined audio signals from the synthesizers 325 and 326 are then supplied via the amplifiers 391 and 392 to the speakers 11SW1 and 11SW2, respectively.

That is, according to the second embodiment, the rear-left and rear-right channel audio signals are subjected to a virtual sound source operation and then supplied to the speakers 11SW1 and 11SW2 placed near the ears of the listener 4 to reproduce sound. Accordingly, it becomes unnecessary to provide the two speakers 11RL and 11RR for the rear-left and rear-right channels.

The processing operation of the audio signal output device 3 according to the second embodiment is such that, in the flowcharts of FIGS. 10 and 11, audio mode 1 in steps S101 and S105 is changed to audio mode 3, which will be described later, and audio mode 2 in steps S103 and S114 is changed to audio mode 4, which will be described later.

In audio mode 3, the following sounds are output from the associated speakers:

front-left channel sound and front-right channel sound are output from the speakers 11FL and 11FR; and low-frequency sound, and rear-left channel sound and rear-right channel sound subjected to virtual sound source operation are output from the speakers 11SW1 and 11SW2.

In audio mode 4, there is no sound output from the speakers 11FL and 11FR, and the following sounds are output from the associated speakers:

low-frequency sound, and front-left channel sound and front-right channel sound subjected to virtual sound source operation are output from the speakers 11SW1 and 11SW2.

In the second embodiment described above, the audio detector automatically switches between the state in which there is no sound output from the speakers 11FL and 11FR (this state will be referred to as "sound-saving ON" below) and the state in which there is sound output from the speakers 11FL and 11FR (this state will be referred to as "sound-saving OFF" below). Alternatively, using a timer, the state may be automatically switched between sound-saving ON and sound-saving OFF according to time.

The timer control applied to the second embodiment will be described below. As shown in FIG. 15, a timer 111 is connected to the system bus 102 in the audio signal output device 3 according to the second embodiment to provide timer control.

In this example, the sound-saving ON time and the sound-saving OFF time can be set by the user 4 using the remote commander 5. In this example, plural sound-saving ON times and sound-saving OFF times can be set within 24 hours a day. Alternatively, only sound-saving ON times may be set, and no sound-saving OFF times may be set.

Figure 17:
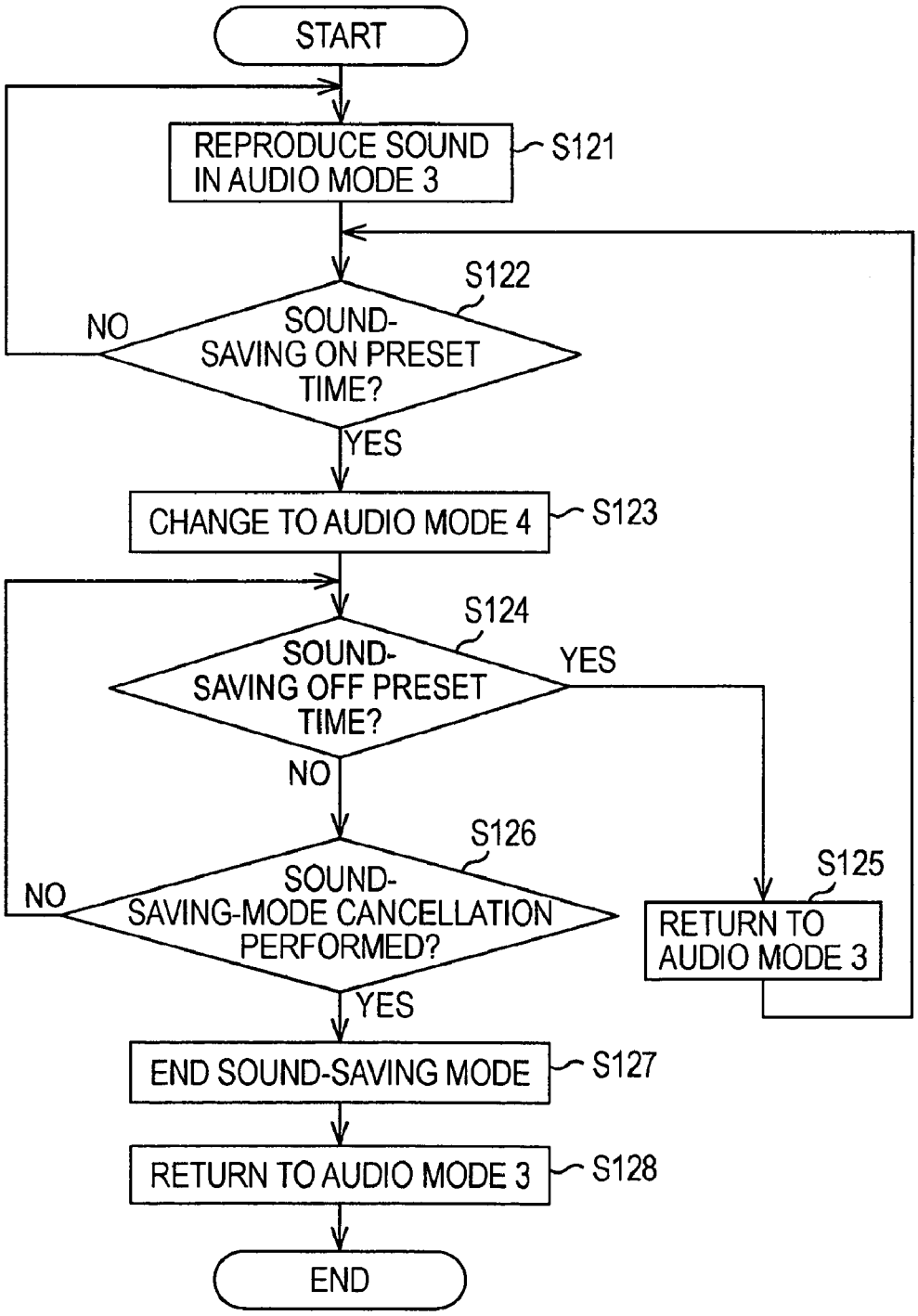
FIG. 17 is a flowchart for illustrating part of an exemplary processing operation according to the second embodiment.

FIG. 17 is a flowchart for illustrating the processing operation of the audio signal output device 3 for switching between sound-saving ON and OFF using timer control. The processing operation is performed in the sound saving mode.

As shown in FIG. 17, in the sound saving mode, the audio signal output device 3 initially reproduces sound from an audio signal from the DVD player 2 in audio mode 3 (step S121). Here, the CPU 101 supplies a control signal serving as a level adjustment control signal supplied from the input/output port 109 to the level adjusting circuits 323 and 324 so that the audio signals from the HRTF convolutional circuits 321 and 322 are not supplied to the amplifiers 391 and 392. Thus, only the combined signals of the low-frequency audio signal LFE and the rear-left and rear-right channel audio signals from the HRTF convolutional circuits 327 and 328, which are subjected to a virtual sound source operation, are supplied to the speakers 11SW1 and 11SW2, and sound is reproduced.

In this state, the CPU 101 refers to the timer 111 to determine whether it is the sound-saving ON preset time (step S122). If it is determined that it is not the sound-saving ON preset time, the flow returns to step S121, and sound is reproduced in audio mode 3.

When it is determined in step S122 that it is the sound-saving ON preset time, the CPU 101 changes the audio mode from audio mode 3 to audio mode 4 (step S123).

In audio mode 4, the CPU 101 supplies a muting control signal via the input/output port 108 to the amplifiers 35 and 36 to stop supplying the audio signals to the speakers 11FL and 11FR. At the same time, the CPU 101 supplies a level adjustment control signal via the input/output port 109 to the level adjusting circuits 323 and 324 so that, besides the low-frequency audio signal LFE, the front-left and front-right channel audio signals from the HRTF convolutional circuits 321 and 322, which are subjected to a virtual sound source operation, are supplied to the speakers 11SW1 and 11SW2.

Next, the CPU 101 determines whether it is the sound-saving OFF preset time (step S124). If it is determined that it is the sound-saving OFF preset time, the CPU 101 returns the audio mode to audio mode 3 (step S125). Thereafter, the flow returns to step S122, and the operation from step S122 onward is repeated.

If it is determined in step S124 that it is not the sound-saving OFF preset time, the CPU 101 determines whether a sound-saving-mode cancellation signal serving as a remote control signal is received (step S126). If it is determined that no sound-saving-mode cancellation signal serving as a remote control signal is received, the flow returns to step S124, and the operation from step S124 onward is repeated.

If it is determined in step S126 that a sound-saving-mode cancellation signal serving as a remote control signal is received, the CPU 101 ends the sound-saving mode (step S127) and returns the audio mode to audio mode 3 (step S128). The sound-saving-mode operation ends here.

Although the above description of timer control is applied to the second embodiment, it is also applicable to the first embodiment. When it is applied to the first embodiment, audio mode 3 in steps S121, S125, and S128 in FIG. 17 is changed to audio mode 1, and audio mode 4 in step S123 is changed to audio mode 2.

Other Embodiments and Modifications

In the above description of the embodiments, the case in which multi-channel sound is reproduced has been described by way of example. However, the present invention is not limited to such multi-channel sound reproduction. For example, the present invention is applicable to, for example, an apparatus having monaural or stereo speakers of a television receiver as other speakers and additional first and second speakers.

Although speakers for reproducing low-frequency sound of multi-channel sound are used as the first and second speakers in the above-described embodiments, the present invention is not limited thereto. For example, when sound is output from the other speakers, the first and second speakers may output no sound.

In the above description, audio signals supplied to the speakers 11FL and 11FR of the television receiver 1 are generated by the audio signal output device 3. Alternatively, the audio signal Au (combined signal of multi-channel audio signals) from the DVD player 2 may be supplied to the television receiver 1, and the speakers 11FL and 11FR may output that sound. In this case, muting control of the speakers 11FL and 11FR is performed by the television receiver 1.

In the above description of the embodiments, the two audio detectors are provided and used. Alternatively, one of the two audio detectors may be used.

In the above-described embodiments, the level adjusting circuits 323 and 324 operate in a switching manner to output or not output the input audio signals. Alternatively, the level of sound output from the speakers 11FL and 11FR may be detected. When the output sound is attenuated by turning down the volume, the volume adjustment amount is detected from a remote control signal. For the reduced amount, the level of audio signals supplied to the speakers 11SW1 and 11SW2, which are subjected to a virtual sound source operation, may be increased.

In the above-described embodiments, sound-saving is automatically turned ON/OFF. Alternatively, for example, a sound-saving ON/OFF operation button may be provided on the remote commander to allow the user to manually instruct sound-saving ON/OFF.

In the above-described embodiments, besides the front-left and front-right channel signals among the 5.1-channel surround signals, the center channel audio signal is supplied to the speakers 11FL and 11FR of the television receiver 1. Alternatively, only the front-left and front-right channel signals may be supplied to the speakers 11FL and 11FR, and the center channel audio signal may contribute to an additional center channel speaker provided as one of the other speakers.

In the above description of the embodiments, the case in which there is no sound output from the speakers 11FL and 11FR has been described by way of example. However, it is not necessary that the volume of the output sound be zero. The present invention is similarly applicable to the case in which the sound output from the speakers 11FL and 11FR is turned down to a very low level.

Although the speakers placed near the ears of the listener 4 are mounted on the chair in the above-described embodiments, the present invention is not limited to such a structure. For example, the speaker units may be held on a stand, and the speakers may be placed near the ears. Alternatively, the speaker units may be hanged from the ceiling using fixtures or may be mounted on the wall using fixtures.

Figure 18:
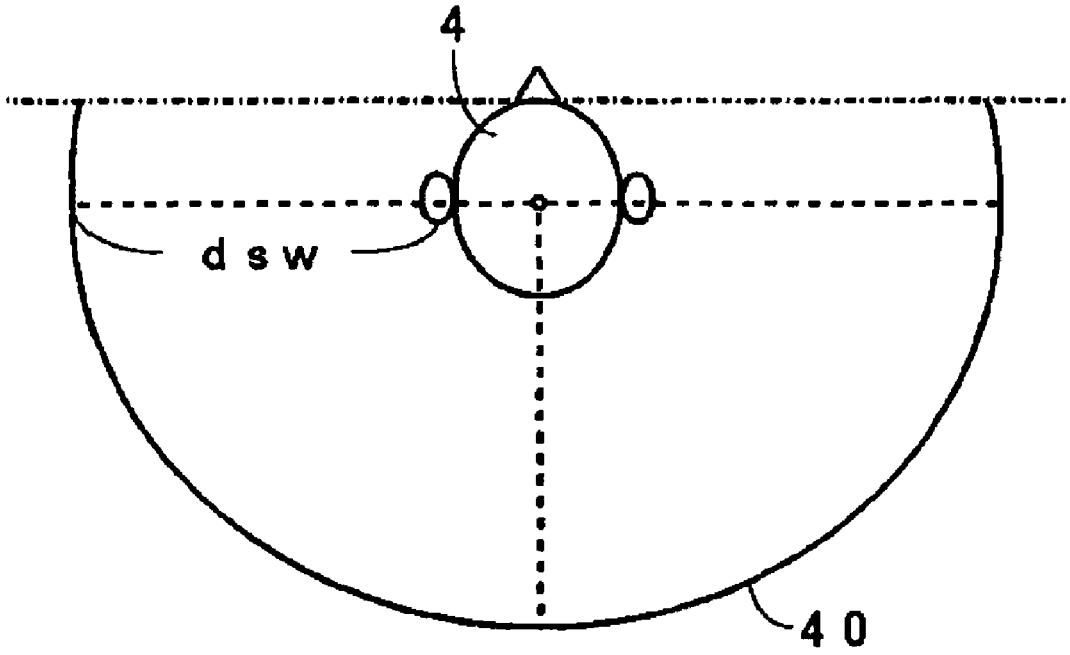
FIG. 18 is a diagram for illustrating an exemplary speaker placement according to another embodiment of the present invention.

In the above-described embodiments, since the low-frequency sound reproducing subwoofers are placed at positions facing the ears of the listener, the efficiency of low-frequency sound in reaching the listener is high. However, the positions at which the subwoofers are placed are not limited to these positions. Alternatively, for example, as shown in FIG. 18, the subwoofers may be placed at any position on the sphere around the head of the listener 4, the radius of which is, for example, (dsw+½ of the radius of the head of the listener 4). However, the subwoofers may preferably not be placed in front of the face of the listener 4. As shown in FIG. 18, the subwoofers may preferably be placed behind the face of the listener 4.

It should be understood by those skilled in the art that various modifications, combinations, sub-combinations and alterations may occur depending on design requirements and other factors insofar as they are within the scope of the appended claims or the equivalents thereof.

What is claimed is:

1. An audio reproducing apparatus comprising:

detecting means for determining whether or not there is sound output from a first set of speakers that is further away from a listener than a second set of speakers is, wherein the second set of speakers is near ears of the listener; and an output circuit operable to receive audio signals to be supplied to the first set of speakers, and if the detecting means determines that there is no sound output from the first set of speakers, supply the audio signals to the second set of speakers such that sound is output from the second set of speakers, wherein the output circuit is configured to process the audio signals such that the listener hears the sound output from the second set of speakers as if it were instead output from the first set of speakers.

2. The audio reproducing apparatus according to claim 1, wherein the second set of speakers is held by a holder, wherein speaker units of the second set of speakers are not mounted on baffles, such that sound output from diaphragms of the speaker units can be added.

3. The audio reproducing apparatus according to claim 1, wherein the detecting means is configured to determine whether there is sound output from the first set of speakers based on a status of an amplifier.

4. The audio reproducing apparatus according to claim 1, wherein the detecting means includes sound collecting means for collecting sound, and correlation detecting means for detecting correlation between an audio signal of the sound collected by the sound collecting means and the audio signals to be supplied to the first set of speakers, wherein the detecting means is configured to determine that there is sound output from the first set of speakers when the correlation detecting means detects correlation.

5. The audio reproducing apparatus according to claim 1, wherein the output circuit is configured to control supply of the audio signals to the first set of speakers in accordance with an operation input that the listener inputs through an operation input unit, and wherein the detecting means is configured to monitor the operation input, and to detect whether or not there is sound output from the first set of speakers based on the supply of the audio signals to the first set of speakers.

6. The audio reproducing apparatus according to claim 1, wherein the output circuit is configured to generate audio signals for reproducing multi-channel sound, and to supply a low-frequency audio signal of the multi-channel sound to the second set of speakers regardless of whether or not the detecting means determines that there is sound output from the first set of speakers.

7. The audio reproducing apparatus according to claim 1, wherein the output circuit is configured to generate audio signals for reproducing multi-channel sound including front-left channel sound, front-right channel sound, rear-left channel sound, rear-right channel sound and low-frequency sound, wherein the first set of speakers includes a front-left speaker for reproducing the front-left channel sound and a front-right speaker for reproducing the front-right channel sound, wherein the output circuit is configured to, if the detecting means determines that there is sound output from the first set of speakers, supply rear-left channel, rear-right channel and low-frequency audio signals to the second set of speakers such that the rear-left channel sound, the rear-right channel sound and the low-frequency sound are output from the second set of speakers, and if the detecting means determines that there is no sound output from the first set of speakers, supply front-left channel, front-right channel, rear-left channel, rear-right channel and low-frequency audio signals to the second set of speakers such that the front-left channel sound, the front-right channel sound, the rear-left channel sound, the rear-right channel sound and the low-frequency sound are output from the second set of speakers, wherein the output circuit includes first virtual sound source processing means for processing the front-left and front-right channel audio signals such that the listener hears the front-left channel sound and the front-right channel sound output from the second set of speakers as if they were instead output from the first set of speakers, and second virtual sound source processing means for processing the rear-left and rear-right channel audio signals such that the listener hears the rear-left channel sound and the rear-right channel sound output from the second set of speakers as if they were instead output from the rear left and rear right of the listener.

8. The audio reproducing apparatus according to claim 1, wherein the output circuit is configured to generate audio signals for reproducing multi-channel sound including front-left channel sound, front-right channel sound, rear-left channel sound, rear-right channel sound and low-frequency sound, wherein the first set of speakers includes a front-left speaker for reproducing the front-left channel sound and a front-right speaker for reproducing the front-right channel sound, wherein the output circuit is configured to supply low-frequency audio signals to the second set of speakers such that the low-frequency sound is output from the second set of speakers, supply rear-left and rear-right channel audio signals to a third set of speakers behind the ears of the listener, such that the rear-left channel sound and the rear-right channel sound are output from the third set of speakers, and if the detecting means determines that there is no sound output from the first set of speakers, supply front-left and front-right channel audio signals, in addition to the low-frequency audio signals, to the second set of speakers, such that the front-left channel sound, the front-right channel sound and the low-frequency sound are output from the second set of speakers, wherein the output circuit includes virtual sound source processing means for processing the front-left and front-right channel audio signals such that the listener hears the front-left channel sound and the front-right channel sound output from the second set of speakers as if they were instead output from the first set of speakers.

9. An audio reproducing apparatus comprising:

a timer operable to determine when a preset time has been reached; and an output circuit operable to receive audio signals to be supplied to a first set of speakers that is further away from a listener than a second set of speakers is, wherein the second set of speakers is near ears of the listener, and if the timer determines that the preset time has been reached, supply the audio signals to the second set of speakers such that sound is output from the second set of speakers, wherein the output circuit is configured to process the audio signals such that the listener hears the sound output from the second set of speakers as if it were instead output from the first set of speakers.

10. The audio reproducing apparatus according to claim 9, wherein the second set of speakers is held by a holder, wherein speaker units of the second set of speakers are not mounted on baffles, such that sound output from diaphragms of the speaker units can be added.

11. An audio reproducing apparatus comprising:

an input circuit operable to receive an operation signal based on an input operation performed by a listener; and an output circuit operable to receive audio signals to be supplied to a first set of speakers that is further away from the listener than a second set of speakers is, wherein the second set of speakers is near ears of the listener, and if the operation signal comprises an instruction to stop or reduce sound output from the first set of speakers, supply the audio signals to the second set of speakers such that sound is output from the second set of speakers, wherein the output circuit is configured to process the audio signals such that the listener hears the sound output from the second set of speakers as if it were instead output from the first set of speakers.

12. The audio reproducing apparatus according to claim 11, wherein the second set of speakers is held by a holder, wherein speaker units of the second set of speakers are not mounted on baffles, such that sound output from diaphragms of the speaker units can be added.

13. An audio reproducing method comprising:

detecting whether or not sound is output from a first set of speakers that is further away from a listener than a second set of speakers is, wherein the second set of speakers is near ears of the listener;

processing audio signals that were to be supplied to the first set of speakers; and if it is detected that no sound is output from the first set of speakers, supplying the processed audio signals to the second set of speakers such that sound is output from the second set of speakers, wherein the processing comprises processing the audio signals such that the listener hears the sound output from the second set of speakers as if it were instead output from the first set of speakers.

14. An audio reproducing apparatus comprising:

a detector operable to detect whether or not sound is output from a first set of speakers that is further away from a listener than a second set of speakers is, wherein the second set of speakers is near ears of the listener; and an output circuit operable to receive audio signals to be supplied to the first set of speakers, and if the detector detects that no sound is output from the first set of speakers, supply the audio signals to the second set of speakers such that sound is output from the second set of speakers, wherein the output circuit is configured to process the audio signals such that the listener hears the sound output from the second set of speakers as if it were instead output from the first set of speakers.

15. The audio reproducing apparatus according to claim 1, wherein the detecting means is configured to detect whether there is sound output from the first set of speakers based at least in part on whether sound collected from the first set of speakers is greater than or equal to a predetermined level.

16. The audio reproducing apparatus according to claim 1, wherein the detecting means is configured to determine that there is no sound output from the first set of speakers when silence detected from the first set of speakers continues for at least a predetermined time.

17. The audio reproducing apparatus according to claim 2, wherein the holder and the speaker units are configured such that sound output from fronts and backs of the diaphragms differ in phase by 180 degrees.

18. The audio reproducing apparatus according to claim 2, wherein the holder and the speaker units are configured such that low-frequency sounds are attenuated.

19. The audio reproducing apparatus according to claim 1, wherein the second set of speakers is mounted on a chair in which the listener sits.

20. The audio reproducing apparatus according to claim 11, wherein the output circuit is configured to increase the volume of the sound output from the second set of speakers, if the operation signal comprises an instruction to decrease the volume of sound output from the first set of speakers.

21. The audio reproducing apparatus according to claim 6, wherein the output circuit is further configured to supply the low-frequency audio signal to a third set of speakers behind the ears of the listener, in addition to the second set of speakers near the ears of the listener.

* * * * *